US005386172A

United States Patent [19]

Komatsu

[11] Patent Number: 5,386,172

[45] Date of Patent: Jan. 31, 1995

[54] MULTIPLE ELECTRODE FIELD ELECTRON EMISSION DEVICE AND METHOD OF MANUFACTURE

[75] Inventor: Hiroshi Komatsu, Suwa, Japan

[73] Assignee: Seiko Epson Corporation, Tokyo, Japan

[21] Appl. No.: 882,436

[22] Filed: May 13, 1992

[30] Foreign Application Priority Data

| | | | |
|---|---|---|---|
| May 13, 1991 | [JP] | Japan | 3-107505 |
| Jul. 4, 1991 | [JP] | Japan | 3-164636 |
| Jul. 25, 1991 | [JP] | Japan | 3-186203 |
| Aug. 7, 1991 | [JP] | Japan | 3-222088 |
| Oct. 29, 1991 | [JP] | Japan | 3-309757 |
| Mar. 2, 1992 | [JP] | Japan | 4-80380 |

[51] Int. Cl.[6] ..... H01J 1/02; H01J 1/16

[52] U.S. Cl. ..... 313/309; 313/336; 313/351

[58] Field of Search ..... 313/309, 336, 351

[56] References Cited

U.S. PATENT DOCUMENTS

| | | | |
|---|---|---|---|
| 3,970,887 | 7/1976 | Smith et al. | 313/309 |
| 4,578,614 | 3/1986 | Gray et al. | 313/309 |
| 4,683,399 | 7/1987 | Soclof | 313/309 X |
| 4,721,885 | 1/1988 | Brodie | 313/309 X |
| 4,827,177 | 5/1989 | Lee et al. | 313/309 X |
| 4,908,539 | 3/1990 | Meyer | 315/169 |
| 4,940,916 | 7/1990 | Borel et al. | 313/306 |
| 5,012,153 | 4/1991 | Atkinson et al. | 313/309 X |
| 5,070,282 | 12/1991 | Epsztein | 315/383 |
| 5,148,079 | 9/1992 | Kado et al. | 313/309 |

FOREIGN PATENT DOCUMENTS

| | | |
|---|---|---|
| 0172089 | 2/1986 | European Pat. Off. . |
| 260075 | 3/1988 | European Pat. Off. . |
| 0316214 | 5/1989 | European Pat. Off. . |
| 0376825 | 7/1990 | European Pat. Off. . |
| 0400406 | 12/1990 | European Pat. Off. . |
| 406886 | 1/1991 | European Pat. Off. . |
| 0444670 | 9/1991 | European Pat. Off. . |
| 121454 | 10/1978 | Japan . |
| WO91/02371 | 2/1991 | WIPO . |

OTHER PUBLICATIONS

C. A. Spindt et al., "Physical properties of thin-film field emission cathodes with molybdenum cones", Journal of Applied Physics, vol. 47, No. 12, Dec. 1976, pp. 5248–5263.

J. Ito, "Vacuum Microelectronics", Applied Physics, vol. 39, No. 2, 1990, pp. 164–169.

R. E. Neidert et al., "Field Emission Triodes", IEEE Transactions on Electron Devices, vol. 38, No. 3, Mar. 1991, pp. 661–665.

*Primary Examiner*—Sandra L. O'Shea

*Attorney, Agent, or Firm*—Eric B. Janofsky

[57] ABSTRACT

A multiple electrode field electron emission device is formed on an insulating layer disposed on a surface of an insulated flat substrate and has a cathode with multiple of emission projections each having a projection tip that overhangs the insulating layer. The device further includes an anode for collecting electrons ejected from the cathode emission projections formed on the surface of the substrate. Control electrodes, having one of several alternate configurations, are formed between the cathode and the anode. The device is fabricated using over-etching and directional particulate deposition techniques.

24 Claims, 30 Drawing Sheets

MULTIPLE ELECTRODE FIELD ELECTRON EMISSION DEVICE AND METHOD OF MANUFACTURE

BACKGROUND OF THE INVENTION

1. Fields of the Invention

This invention generally relates to electron emission devices and more particularly to a multiple electrode field electron emission device which controls field emitted electrons originating from a cold cathode. More specifically, this invention relates to a multiple electrode field electron emission device having a linearly related input signal voltage and anode current, which is useful and/or advantageous in applications, such as, power amplifiers, linear amplifiers, and switching circuits.

2. Related Technology

An example of a multiple electrode field electron emission device is reported by Junji Ito in *Journal of Applied Physics,* Vol. 59, No. 2, on pages 164 to 169 (1990). A generalized illustration of such a multiple electrode field electron emission device is shown in FIG. 33, and is referred to as a flat triode emission device. A wedge shaped emitter electrode (cathode) 102 and a gate electrode 103, which is a column, and an anode 104 are sequentially fabricated on one surface of a quartz substrate base 101. The three electrodes are formed by using a photo-etching process to deposit and shape a thin tungsten film about one micron thick. The emitter electrode 102 has a series of about 170 electrode elements or tips which have a pitch of 10 microns and form a linear array. The separation distance between gate electrode 103 and emitter electrode 102 is 15 microns and between the gate electrode 103 and anode 104 is 10 microns.

When the electrical properties of this triode structure are measured in a vacuum of $5\times10^{-6}$ pa, the emitter exhibits a Fowler-Nordheim (F-N) tunnel current type emission current. With the gate and anode voltages set at 220 V and 318 V, respectively, an anode current of about 1.2 microamps is obtained. This amounts to about 7 nA of anode current for each emitter electrode element and the mutual conductance for these elements is about 0.1 $\mu$S.

However, such a triode device structure has a number of potential problems. While electrons emitted from electrode 102 proceed toward anode 104 some flow to positively biased gate electrode 103 because of its intermediate position between the two other electrodes. Because the gate current is equal to or higher than the anode current, the gate input resistance is very small. That is, the electron yield (anode current divided by total emission current) flowing to anode 104 decreases, causing a reduction in electrical properties because characteristics such as power efficiency and mutual conductance are reduced. Therefore, this technology provides about a 60% yield. When controlling anode current with a low gate input resistance triode device, it is necessary to provide a circuit or isolation element to accommodate large current and power in signals input to gate electrode 103. This limitation makes it difficult to use current triode devices as current amplifiers and power switches.

In addition, the triode emission current is in the form of Fowler-Nordheim (F-N) tunnel current, which increases or decreases exponentially relative to changes in the gate voltage. As a result, the anode output current relative to the gate input signal changes exponentially. Triode devices possessing this type of non-linear input and output relationship, are not capable of being used for applications such as linear amplifiers.

Furthermore, in order to increase performance by enlarging the mutual conductance of the triode device, it is necessary to modify the gate electrode 103 structure and enlarge the emission surface area of emitter electrode 102. However, enlarging the emission surface area also increases the number of electrons flowing to gate electrode 103. Therefore, a power amplifier with high performance can not be obtained using current technology.

Cathode 102 and gate electrode 103 are typically fabricated during the same photo-etching process. Electrode separation is determined by the resolution of the photoresist process or exposure, and is practically limited to 0.8 microns. Furthermore, as process geometries become smaller, variations increase. The magnitude and uniformity of the threshold voltage for electron emission in the field electron emission device largely depends on the cathode 102 and gate electrode 103 separation. As a result, reducing threshold voltage in current triode devices is difficult and even when successful provides poor uniformity.

The threshold voltage of the field electron emission device also depends chiefly on the radius of curvature for the tip of the cathode 102 elements. That is, the smaller the radius of curvature for an electrode tip, the lower the threshold voltage. To obtain a practical threshold voltage, it is desirable to have a tip radius of curvature of 1000 angstroms or less. However, fabrication of a practical tip radius of curvature is difficult with current processing technology, which is generally limited to 2000 angstroms because of photoresist seepage.

Therefore, the present invention was developed to overcome these problems found in the art. Purposes and objectives of the invention include offering a high performance multiple electrode field electron emission device with a large gate input resistance, a linear input and output relationship, a large mutual conductance, and offering a manufacturing process for such a multiple electrode field electron emission device.

SUMMARY OF THE INVENTION

These and other purposes, objectives, and advantages are realized in a multiple electrode field electron emission device comprising at least one field effect electron emitting cathode, a gate electrode for applying an electric field to the cathode, and a control electrode disposed between the cathode and anode so as to control the flow rate of emitted electrons. In a preferred embodiment, at least one island shaped insulating layer is formed on one surface of a flat substrate base on top of which is formed the cathode. The cathode has one or more emission projections that overhang the edge of the island shaped insulating layer. The gate electrode is formed on the same substrate surface in a generally vertical proximity to the emission projections, the anode is formed on the substrate surface between the gate electrode and an opposite side of the cathode, and the control electrode is disposed on the substrate between the gate electrode and the anode.

In further embodiments, a screen electrode is employed between the control electrode and the anode to electrostatically screen the control electrode and the anode, and a suppresser electrode is disposed between the screen electrode and the anode to control secondary electrons emitted by the anode. Portions of the control and screen electrodes can each have a substantially columnar shape.

In further aspects of the invention, the gate electrode is constructed with at least one opening substantially aligned with an emission projection for passage of electrons emitted from said emission projection. The control electrode can be similarly configured. These openings or electron passages can be manufactured by first forming conductive layers on the flat substrate for the gate or control electrodes and then covering them with a layer of resist material which is patterned to cover the electrode, or electrodes, only in regions in alignment with the preselected ones of the cathode emission projections. Additional conductive material, typically the same as the first layer, is then deposited over the resist and secures itself to the electrodes where not covered by resist. Where desired additional resist can be deposited on top and used to further contour or pattern the conductive material. The resists are then chemically removed leaving tubular openings between the new conductive material and the flat electrodes, thus, forming tubular electrodes.

The multiple electrode field electron emission device can be constructed as a vertical device with a substantially pointed shaped cathode formed with a peripheral boundary on a surface of the conductive flat substrate and having an elongated axis substantially perpendicular to the substrate surface so that the cathode projects upward from the substrate surface. A first insulating layer is then formed on the substrate surface with an opening above the cathode and about its peripheral boundary. A gate electrode layer is then formed on the first insulating layer, having an opening substantially matching that of the first insulating layer. In this configuration an opposing substrate is spaced apart from this opening and an anode layer is formed on its surface facing the cathode. A control electrode is then disposed in between the gate electrode and anode.

The multiple electrode field electron emission device of the present invention can be driven using several approaches including grounding the cathode, applying positive bias voltage to the gate electrode, applying a positive bias voltage to the anode larger than the voltage on the gate; and applying an input signal voltage on the control electrode to control the amount of anode current flow. Alternatively, the gate electrode can be grounded while applying negative bias voltage to the cathode and positive bias voltage to the anode. The negative bias cathode voltage can be applied to the cathode through a series resistance. When a screen electrode is positioned between the control electrode and the anode a positive bias screen voltage can be applied on the screen electrode.

The method of manufacturing the field electron emission device of this invention comprises the steps of forming a cathode on one surface of a flat substrate base having at least one emission projection positioned substantially parallel to the surface of the flat substrate, depositing and forming an etching mask layer on the flat substrate base, forming a cathode on the surface of the etching mask layer, and an etching passivation layer on the surface of the cathode. The etching mask layer is fabricated and the etching mask formed with a series of emission projections, and the cathode layer is formed in the shape of the etching mask so to cream a cathode with emission projections.

In addition, the method of manufacturing the field electron emission device of this invention can employ the steps of forming an etching mask layer on the surface of a flat substrate base, forming a cathode layer on the etching mask layer, forming a resist layer on the cathode layer, fabricating the cathode layer in the shape of the surface of the resist layer, shaping, and contouring the etching mask layer, using an over-etching method, removing the etching mask from a lower periphery of the cathode and patterning the cathode in the shape of an eaves. The gate electrode layer is typically formed using directional particulate deposition. The cathode layer is patterned to have a plurality of projections overhanging from the insulating layer. An anode for collecting emitted electrons is formed on the surface of the substrate and a gate electrode is formed between the cathode and the anode. The gate is made with at least one opening corresponding in location to the emission projections, and a control electrode is formed between the gate electrode and the anode.

The multiple electrode field electron emission device of this invention may use at least one cathode that emits electrons under field effect, a gate electrode that puts an electric field on the cathode, an anode that collects emitted electrons, and a control electrode that is placed between the cathode and the anode to control the emitted electrons. In addition to the cathode, gate electrode, control electrode, and anode, a screen electrode is formed between the control electrode and the anode to electrostatically screen the anode, and a suppresser electrode is formed between the screen electrode and the anode to control the secondary electrons of the anode.

The cathode of this invention is formed on the surface of the insulating layer, which is formed on the insulated flat substrate and has emission projections that overhang from the insulating layer. The insulating layer may be formed in the shape of an island in correspondence with the shape of the emission projections. The opening in the gate electrode layer is for the purpose of efficiently collecting emitted electrons from the cathode on the anode. If, for example, the opening was a ring shape and was formed at the location of the opening, there would be a marked reduction in the volume of electrons that flow to the gate electrode and the gate input resistance would become very high. That is, the gate and control currents decrease as a result of emission current flowing through the inside of the opening of the ring shape and parasitic currents also decrease.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 29D is a cross sectional view taken along the line 29D—29D of FIG. 29C.

DETAILED DESCRIPTION OF PREFERRED EMBODIMENTS

Figure 1:
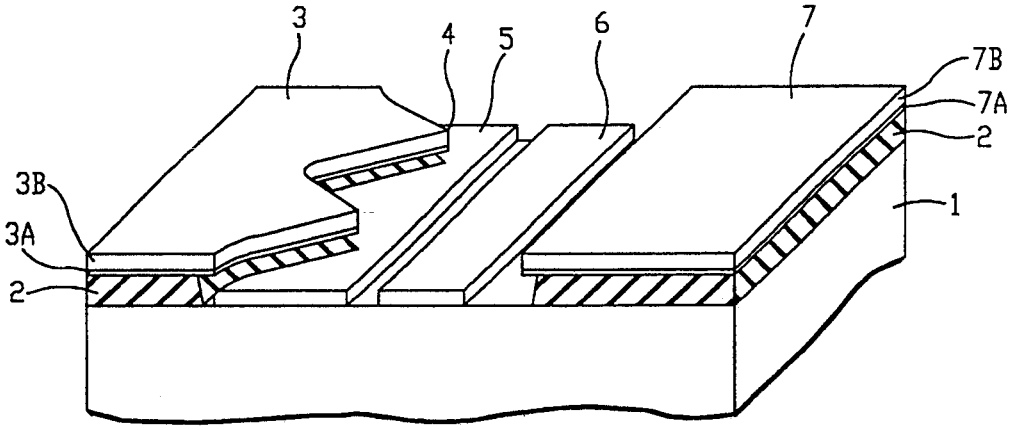
FIG. 1 illustrates a perspective view of a tetrode field electron emission device of a first embodiment of the present invention.

FIG. 1 is a cross sectional schematic view of a part of a tetrode field electron emission device manufactured and operating according to the principles of this invention. In FIG. 1, a tetrode device is shown using a gate electrode 5 and control electrode 6, each formed as a thin film of conductive material such as molybdenum (Mo), about 1,000 angstroms thick on one surface of a flat substrate base 1, which is generally made of quartz. An insulating layer 2, which is on the order of 5,000 angstroms thick and made of an insulating material such as silicon dioxide, is disposed on substrate 1 adjacent to both gate electrode 5 and control electrode 6. A cathode 3 is formed on one surface of insulating layer 2 adjacent to gate electrode 5, and is about 2,000 angstroms thick. Cathode 3 is configured with overhanging emission projections 4 which project over a portion of electrode 5. An anode 7 is formed on the surface of insulating layer 2 adjacent to control electrode 6, which is about 2,000 angstroms thick.

Cathode 3 is formed as a two-layer deposition, thin film, structure with the first cathode layer 3A made of tungsten (W) with a thickness of about 1,000 angstroms and the second deposited cathode layer 3B made of molybdenum (Mo) with a thickness of about 1,000 angstroms. Like cathode 3, the structure of anode 7 is such that the first anode layer 7A and the second anode layer 7B are both deposited. The four electrodes, that is, cathode 3, gate electrode 5, control electrode 6 and anode 7, are placed on the surface of flat substrate base 1 in this respective sequence.

Cathode 3 is configured to have emission projections 4, which are aligned in a row with a pitch of about 5 microns. Emission projections 4 are structured so that they project parallel to the direction of gate electrode 5, which is on the surface of flat substrate base 1. Island shaped insulating layer 2 is patterned so that it does not exist in the vicinity of the emission projection tips. The radius of curvature for the tip of emission projections 4 along the flat direction is about 400 angstroms.

Gate electrode 5 is formed so that it self-aligns to cathode 3 and has a recession area of nearly the same shape as emission projections 4 in the lower vertical portion of emission projections 4. The distance ($L_{gk}$) between gate electrode 5 and emission projections 4 is determined by the film thicknesses of island shaped insulating layer 2 and gate electrode layer 5. This is a value for which the film thickness of gate electrode 5 is subtracted from the film thickness of island shaped insulating layer 2 ($L_{gk}$=4,000 angstroms). Based on recent methods of structuring thin films, the control of the film thickness is very good. As a result, the controllability of $L_{gk}$, and reproducibility and uniformity of this device are excellent.

The width of gate electrode 5 in the vicinity of emission projection tips 4 is about 2 microns. The spatial distance or spacing between gate electrode 5 and control electrode 6 is on the order of 4 microns. The width of control electrode 6 is about 8 microns. The spatial distance or spacing between control electrode 6 and anode 7 is about 10 microns. The smaller the width of gate electrode 5, the smaller the gate current and the greater the power efficiency. Also, the larger the width and surface area of anode 7, the higher the electron yield. The wider control electrode 6 is, the larger the mutual conductance and the greater the controllability of the anode. However, because the quantity of electrons (control current) that flow to control electrode 6 increases, controllability is determined by a balance between these elements. It is ideal to have dimensions in a range in which the width of control electrode 6 is greater than the width of gate electrode 5 but smaller than the width of anode 7. To increase the amplification factor ($\mu = C_{CG}/C_{AG}$; where $C_{CG}$ is the capacitance between gate electrode 5 and control electrode 6, and $C_{AG}$ is the capacitance between gate electrode 5 and anode 7.), means decreasing the width of control electrode 6 and enlarging the space between control electrode 6 and anode 7.

Figure 2A:
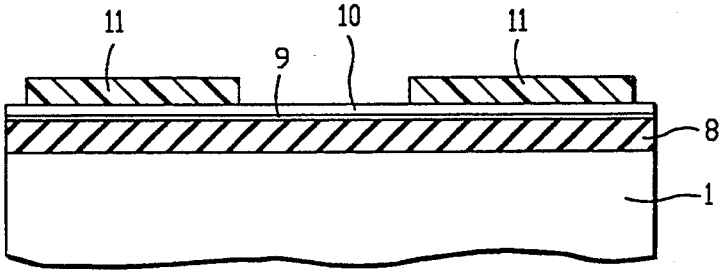
FIGS. 2A–2F are a series of figures illustrating the steps of manufacture of the tetrode field electron emission device of FIG. 1.

FIGS. 2A–2F illustrate cross sectional views of the process of manufacturing the tetrode field electron emission device shown in FIG. 1. FIG. 2A shows the device after sequential formation of insulating layer 8, cathode 9, and etching passivation layer 10 on the surface of flat substrate base 1 and after formation of photoresist layer 11. Flat substrate base 1 is typically manufactured from an insulating quartz material. Insulating layer 8, cathode 9, and etching passivation layer 10 are typically deposited using a sputter deposition process. Insulating layer 8, cathode 9, and etching passivation layer 10 are composed of a 5,000 angstrom silicon dioxide thin film, a 1,000 angstrom tungsten thin film and a 2,000 angstrom silicon dioxide thin film, respectively. Photoresist layer 11 is patterned after a desired shape for cathode 3 and anode 7.

Figure 2B:
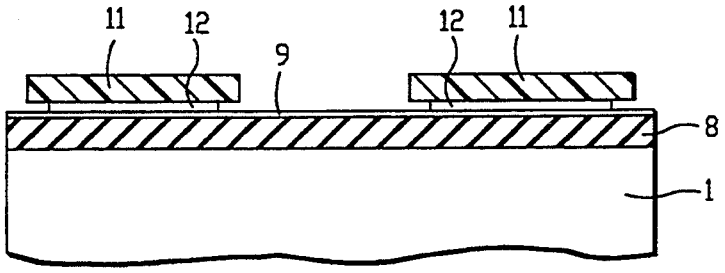

FIG. 2B is a cross sectional view of the device after fabrication of etching passivation layer 10, through over-etching, and etching mask 12. The over-etching technique employs an HF type etching solution which etches away more of etching passivation layer 10 than is delimited by the shape of photoresist layer 11. It is possible to obtain etching mask 12, which has small radius of curvature emission projections 4, by etching passivation layer 10 more than the curvature radius of the area on photoresist layer 11 that corresponds to emission projections 4, from the outer periphery inward. In this embodiment, the curvature radius of photoresist layer 11 is 3,000 angstroms. Therefore, about 5,000 angstroms of over-etching are used to obtain etching mask 12, which has a tip curvature radius on the order of 300 angstroms.

Figure 2C:
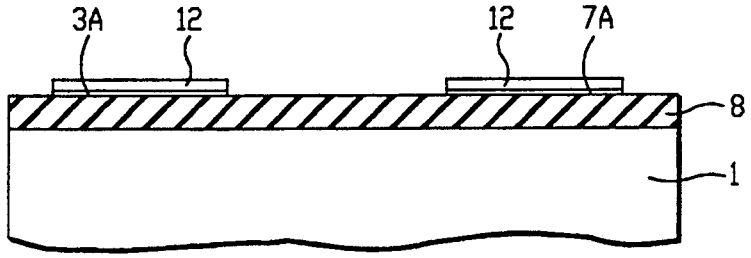

FIG. 2C is a cross-sectional view of the device after cathode layer 9 has been fabricated and after the first cathode layer 3A and the first anode layer 7A have been formed. Etching mask 12, which will have sharp emission projections after the removal of photoresist layer 11, is used to fabricate cathode layer 9. Dry etching is used to fabricate cathode layer 9. Dry etching takes place for five minutes at a gas flow ratio of $CF_4/O_4$=60/200 and an RF power of 700 watts. At this time, cathode 9 is over-etched to obtain the first cathode layer 3A, which exhibits sharp emission projections with a tip curvature radius of about 300 angstroms.

Figure 2D:
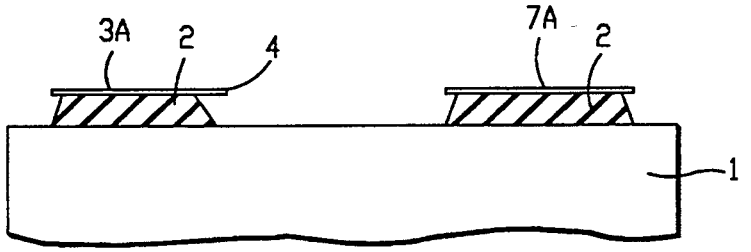

FIG. 2D is a cross-sectional view of the device after the insulating layer 8 has been etched away in sections, forming island shaped insulating layer 2, and exposing emission projections 4. First cathode layer 3A and first anode layer 7A are used as etching masks to remove the unnecessary portion of insulating layer 8 with an HF etching solution and form insulating island layer 2. At this time, emission projections 4 are exposed such that they overhang from island shaped insulating layer 2. Also, etching mask 12 is removed and flat substrate base 1 shows almost no etching because it is made of quartz.

Figure 2E:
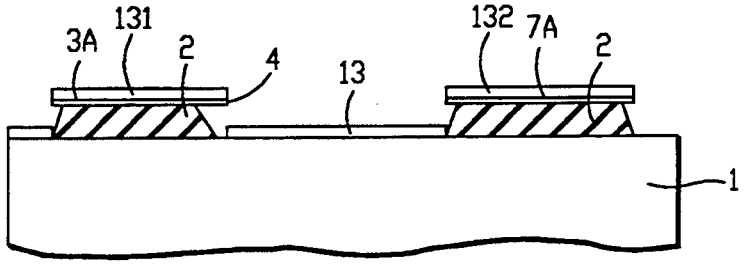

FIG. 2E is a cross-sectional view of the device after gate electrode layer 13 has been formed using the directional particulate deposition method. Sputtering is used as the directional particulate deposition method to deposit a molybdenum (Mo) thin film layer of 1,000 angstroms in thickness to form gate electrode layer 13. The directional particulate deposition method shoots out particles and deposits them on the surface of flat substrate base 1 in a nearly perpendicular direction from the particle source. When this method is used, the overhanging portions, such as emission projections 4, become a cover, allowing molybdenum thin film layer 131, which is deposited on the top of first cathode layer 3A, molybdenum thin film layer 132, which is deposited on the surface of first anode layer 7A, and gate electrode layer 13, which is deposited on the surface of flat substrate base 1, all to be electrically isolated. In addition, emission projections 4 and the overhanging portion, which has the same shape as these projections, are fabricated so that they self-align to the lower vertical portion of emission projections 4. (Even if the position of one of the electrodes is not aligned, the other electrode will be fabricated so that its position corresponds to that vertically aligned position.) Vapor deposition, sputtering, electron cyclotron resonance (ECR), plasma deposition and the clustered ion beam can be used as the directional particulate deposition method.

Figure 2F:
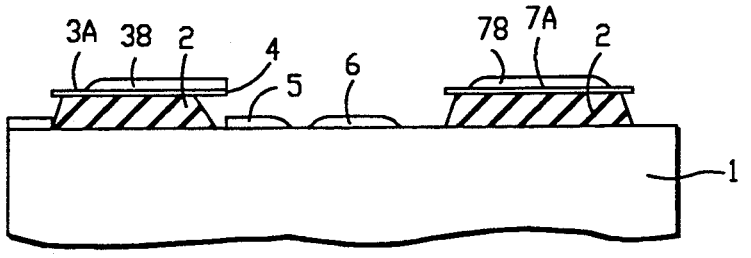

FIG. 2F is a cross-sectional view showing the device after gate electrode 13 and molybdenum thin film layers 131 and 132 have been etched and after second cathode layer 3B, gate electrode 5, control electrode 6, and second anode layer 7B have been fabricated. After photo-etching technology is used and the overhanging portions of emission projections 4 and gate electrode 5 have been covered with photoresist, the molybdenum thin film is etched employing dry etching.

The tip curvature radius of emission projections 4 of cathode 3 of a completed multiple electrode field electron emission device is 400 angstroms. This is due to first cathode layer 3A having more roundness because of the deposition of second cathode layer 3B. However, this roundness causes the surface area of emission projections 4 that is in the electric field to enlarge, making it possible to obtain electron emissions that are large in volume and are stable. Where the materials used for first cathode layer 3A and second cathode layer 3B are different, for the most part, if either the emission projections 4 part of first cathode layer 3A or second cathode layer 3B are etched away, emission projections 4 become thinner and the film thickness direction tip curvature radius becomes smaller, making possible a multiple electrode field electron emission device that has a low threshold value.

If the distance between the cathode and the gate electrode are uniformly shortened and the radius of curvature for the emission projection tips are made small, the threshold voltage is reduced. The manufacturing process for this configuration is described using a triode field electron emission device.

Figure 3:
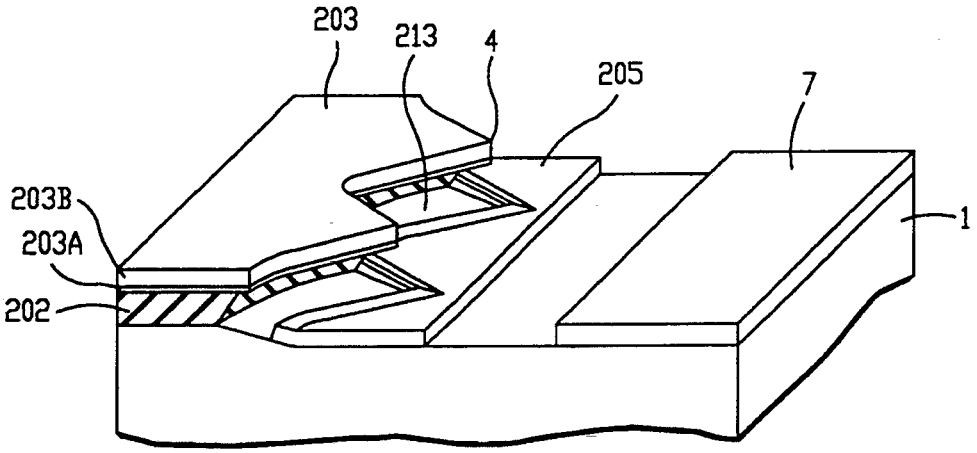
FIG. 3 is an enlarged perspective view of a portion of a new triode field electron emission device illustrating a second embodiment of this invention.

FIG. 3 is a perspective view of a triode field electron emission device manufactured employing this manufacturing process and procedure. The major components of the device are flat substrate base 1, island shaped insulating layer 202, cathode 203, which is equipped with emission projections 4, which are formed as overhangs on the surface of the cathode, gate electrode 205, which is formed so that it self-aligns to emission projections 4, and anode 7, which is formed on the surface of flat substrate base 1. Around island shaped insulating layer 202, particularly in the vicinity of gate electrode 205 on flat substrate base 1, is slope 213. Slope 213 has the advantage of reducing the situations in which electrons emitted from emission projections 4 flow to gate electrode 5, and it improves the power efficiency of the field electron emission device.

The field electron emission device has 100 emission projections which have a 5 micron pitch and are aligned in a row. The tip curvature radius of emission projections 4 is 400 angstroms. The distance between cathode 203 and gate electrode 205 ($L_{GK}$) is 4,000 angstroms. The width of gate electrode 205 at the tip of the emission projections (4) is 2 μm. The distance between cathode 203 and anode 7 ($L_{AK}$) is about 10 μm. Flat substrate base 1 may be made of a #7059 glass substrate manufactured by Corning Glass. Island shaped insulating layer 202 is made of a 5,000 angstrom thick silicon oxide film, and first cathode 203A is made of a 1,000 angstrom thick molybdenum (Mo) thin film. Second cathode **203*b*, gate electrode 205, and anode 7 are all made of a 2,000 angstrom thick tantalum (Ta) thin film. The angle of slope 213** is approximately 10 degrees.

FIGS. 4A–4F are cross-sectional views of flat substrate base 1 at the completion of the main manufacturing steps for the field electron emission device shown in FIG. 3. FIGS. 5A–5C are illustrations of flat substrate base 1 that correspond to FIGS. 4B, 4D, and 4E, respectively. The manufacturing process of the field electron emission device of this embodiment will now be described.

Figure 4A:
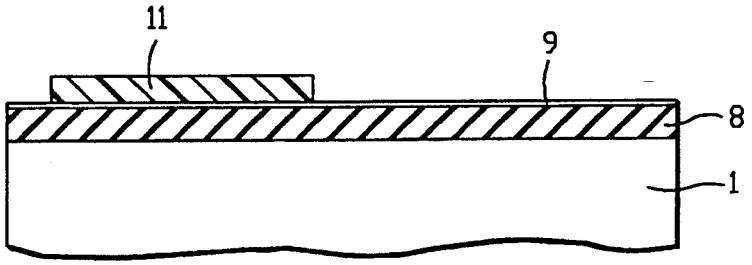
FIGS. 4A–4F are a series of figures illustrating the steps of manufacture of the triode field electron emission device of FIG. 3.
Figure 5A:
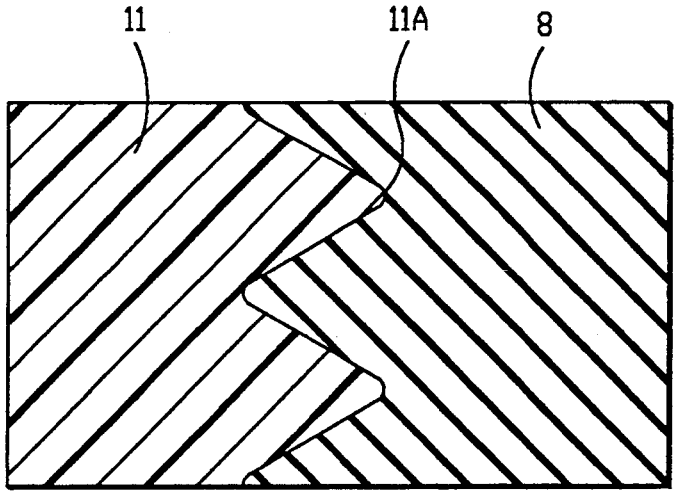
FIGS. 5A–5C are a series of plan views illustrating further manufacturing steps to those shown in FIG. 4.
Figure 5B:
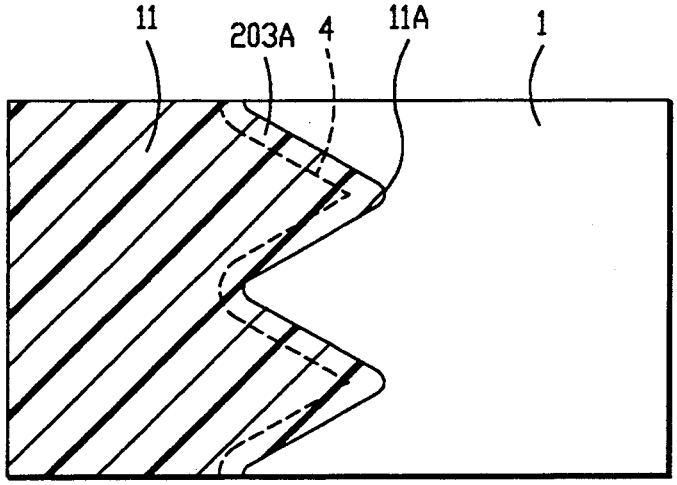
Figure 5C:
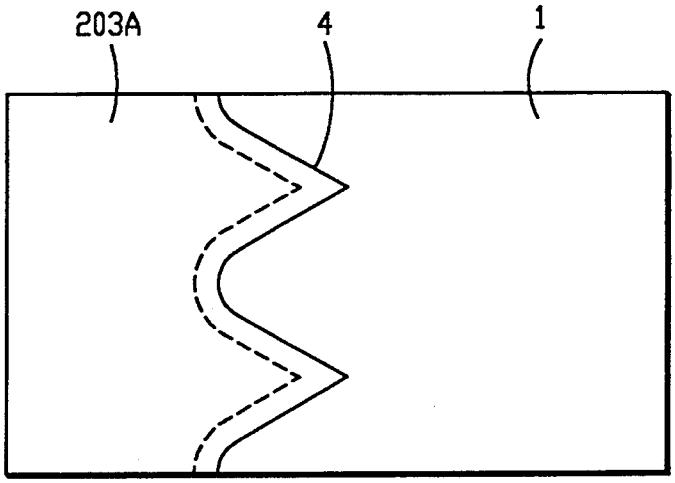

First, insulating layer 8 and cathode layer 9 are formed on the surface of flat substrate base 1 followed by resist layer 11 as illustrated in FIG. 4A. Flat substrate base 1 is manufactured from material such as #7059 glass which has insulating properties. Insulating layer 8 is a 5,000 angstrom thick, thin silicon dioxide film layer formed using atmospheric pressure CVD techniques. Cathode layer 9 is a 1,000 angstrom thick thin molybdenum (Mo) film layer deposited using sputtering. Resist layer 11 is generally in the shape of cathode 203 and is formed using photo-etching.

Figure 4B:
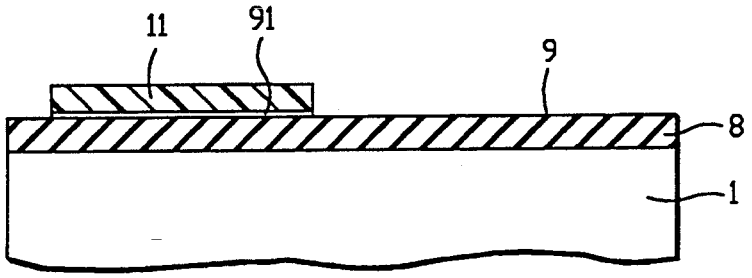

Next, cathode layer 9 is processed through selective shaping of resist layer 11 to form temporary cathode layer 91, which is illustrated in both FIG. 4B and FIG. 5A. The molybdenum thin film cathode layer 9 is etched by means of employing a dry etching method using $CF_4$ gas. The tip of the resist 11A has a tip curvature radius of about 7000 angstroms, which is the same as that for temporary cathode 91.

Figure 4C:
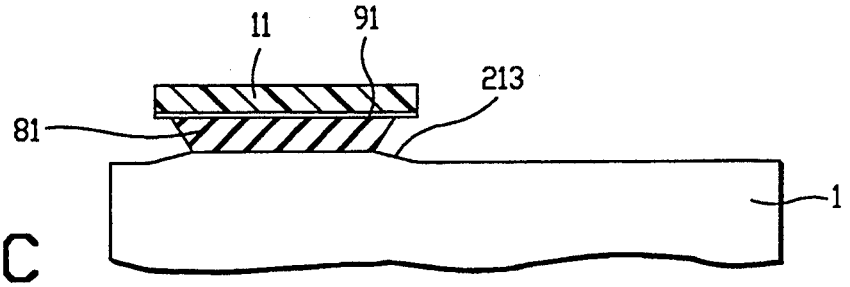

Next, etching mask layer 81 is formed by over-etching or extended etching of insulating layer 8, as illustrated in FIG. 4C. Over-etching is the method in which insulating layer 8 is etched away deep within a stipulated region in temporary cathode 91 using an isotropic etching means. Because etching of temporary cathode 91 progresses at an equal rate from the outer periphery in an inward direction using the isotropic etching means, the convex areas have a sharp shape. As a result, there is a characteristic in which over-etching allows a small tip curvature radius in the convex areas.

In the particular case here, an HF type etching solution is employed as the isotropic etching means to over-etch the silicon dioxide thin film of insulation layer 8. When the outer periphery of temporary cathode 91 is etched to 1.5 microns inward, reverse taper shaped etching mask 81 is formed with a protruding portion with a tip curvature radius of 300 angstroms. Compared to the 7000 angstrom tip curvature radius of temporary cathode 91, a twenty-fold increase in sharpness is achieved. In this process, the surface of flat substrate base 1 is etched to form sloped surface 213 around etching mask 81. The speed of the insulating layer 8 etching is five times faster compared to flat substrate 1. As a result, the grade of the sloping surface 213 that is formed at the foot of emission projection 4 is about 10 degrees.

Figure 4D:
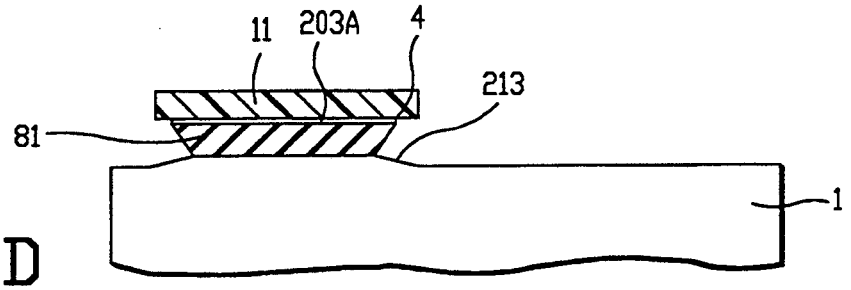

Next, temporary cathode 91 is etched to the shape of etching mask 81 to form first cathode 203A, illustrated in both FIG. 4D and FIG. 5B. With resist layer 11 covering the surface of temporary cathode 91 for protection, etching is performed from the back side, and first cathode 203A is formed having the same flat shape of etching mask 81. The tip curvature radius of emission projections 4 of first cathode layer 203A is about 300 angstroms.

Figure 4E:
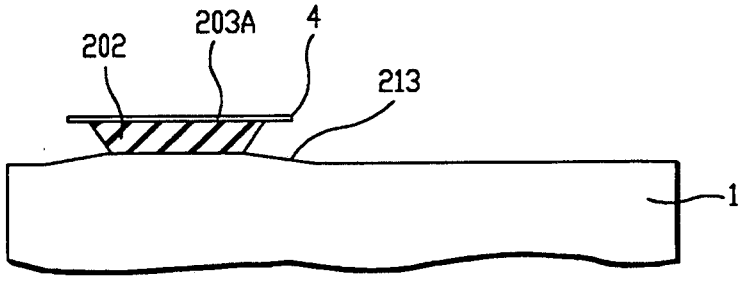

Next, the sides of etching mask 81 are etched away to form island shaped insulating layer 202, and resist layer 22 is removed, as illustrated in both FIG. 4E and FIG. 5C. About 0.7 microns of the sides of etching mask 81 are removed to form cathode 203A in the shape of an eaves and expose emission projections 4 in the shape of overhangs.

Figure 4F:
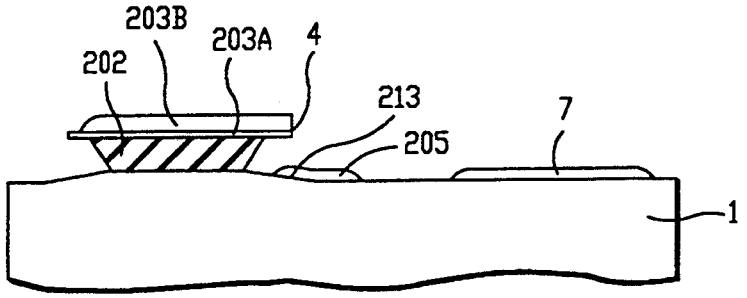

Finally, after forming the Ta electrode layer using directional particulate deposition, it is etched to form second cathode 203B, gate electrode 205, and anode 7, as shown in FIG. 4F. Sputtering is employed with the directional particulate deposition to form gate electrode 205, which is made of a 2000 angstrom Ta thin film. When directional particulate deposition is employed, the overhanging portions, such as emission projections 4, become a cover and second cathode 203B, which is deposited on the surface of first cathode 203A, gate electrode 205, which is deposited on the surface of flat substrate base 1, become electrically isolated.

The overhanging portion, which has the same shape as emission projections 4, is formed so that it self-aligns with emission projections 4. Sputtering, vapor deposition, ECR (electron cyclotron resonance), plasma deposition and the cluster ion beam method are some of the methods that may be used as the directional particulate deposition methods. The electrode layer of the Ta thin film is processed by means of dry etching to form gate electrode 205 and anode 7. At this time, it is important to cover the layer with photoresist so that the overhangs are not corroded. Cathode 203 is an overlapping structure of first cathode 203A and second cathode 203B. The tip curvature radius is about 400 angstroms. In a case in which the material used for first cathode layer 203A and second cathode 203B are different, it is acceptable to remove one of the electrodes at the emission projection and use the remainder as an electron emission electrode. If the emission projections are made thin in this manner, the tip curvature radius in the film thickness direction becomes smaller, allowing lower threshold voltages to be achieved.

A field electron emission device manufactured in accordance with the previous explanation was measured in a high vacuum environment. When the cathode was grounded and the anode cathode voltage was maintained at $V_{ak}=200$ V with a gate cathode voltage of $V_{gk}=60$ V, the cathode current was $I_k=4\times10^{-8}$A. At 100 V, $6\times10^{-5}$ was obtained. In addition, the parasite capacitance between cathode 203 and gate electrode 205 was at a level of 10 fF.

In this embodiment, the material employed for the electrodes, such as, for cathode 203, was molybdenum and tantalum thin films. However, this invention is not limited to these particular materials. In addition to these materials, other materials that may be employed are metals, such as, tungsten, silicon, chrome, and aluminum and alloys of these metals. Furthermore, relative to flat substrate base 1. substrate materials, such as, quartz and ceramic substrates having good thermal conductance may be employed. As an example, an insulating substrate base or an alumina substrate base with an insulator on the surface of a conductive substrate base, such as, a silicon substrate base, may be employed. Moreover, insulating layer 8 and etching mask 81 are not limited to the employment of a silicon dioxide thin film. Thin films, such as, silicon nitride thin films and alumina thin films may also be employed.

In order to reduce the threshold voltage of the electron emissions, it is also acceptable to coat emission projections 4 with materials that have a small work function, such as barium, thorium and cesium. In addition, cathode 203 may be made of such a material.

In order to reduce the noise from electron emissions, it is possible to create an adequate number of emission projections 4 as well as increase the S/N ratio by driving these and creating electron emissions at the same time. Electron emissions do not have to originate at one point, that is, the tip of the emission projections. They can originate from auxiliary projections created on the side of the tip, and this will provide the same effect. In addition, excessive current flow and noise can be prevented by connecting self-bias resistance or non-linear resistance directly to the cathode.

By putting a fluorescent material on the surface of anode 7 and forming a light emitting display or by forming a material such as a copper thin film that generates x-rays and exciting this with an electron beam, it is possible to create a minute x-ray source. Of course, the manufacturing process described above can be used in the same manner in the tetrode field electron emission device shown in FIG. 1.

As described above, the manufacturing process of the field electron device of this invention provides the following improved advantages:

(1) Compared to fabricating the cathode by extended etching of the cathode layer or by extended etching of the etching mask layer formed on the surface of the cathode layer, it is possible to fabricate emission projections having a smaller tip curvature radius. This is because the etching properties of the etching mask formed on the surface of flat substrate base 1 are very isotropic and because etching methods that etch at a fast rate, such as wet etching, can be used. Because it is difficult to apply wet etching to materials such as molybdenum, it is also difficult to form emission projections 4 by means of extended etching of such materials.

(2) $L_{gk}$ is generally determined by the film thickness of the island shaped insulating layer and the gate electrode. The ability to control the film thickness has increasingly become improved and accurate as LSI processing technology has progressed, thereby making it possible to achieve a field electron emission device with excellent uniformity and a low electron emission threshold voltage. In the technology utilized in conjunction with known emission devices, the achievable limit for $L_{gk}$ was 0.8 $\mu$m. However, as a result of the method of this invention, it is possible to fabricate and obtain a limit for $L_{gk}$ at or below 0.1 $\mu$m.

(3) Emission projections with a small tip curvature radius and a low threshold voltage were achieved employing extended etching. In the technology utilized in conjunction with known emission devices, the lowest limit of the tip curvature radius is generally 2000 angstroms. With this invention, it is possible to obtain tip curvature radii of 400 angstroms or smaller.

(4) Employing extended etching, the characteristics achieved for emission projections 4, i.e., convex areas, are a smaller, sharper tip curvature radius. Conversely, the concave areas developed are much smoother. With such dual characteristics, it is possible to take advantage of the convex and concave areas of the cathode to prevent accidental electron emissions and shorting conditions between the electrodes.

(5) It is possible to create a gate electrode which is self-aligned with the cathode of the emission device thereby allowing a reduction in parasitic capacitance between the electrodes and high-speed operation as well. In particular, by creating the first cathode with low resistivity, the emission device is suitable for high-speed applications requiring a low line resistance and smaller line delays.

Figure 6A:
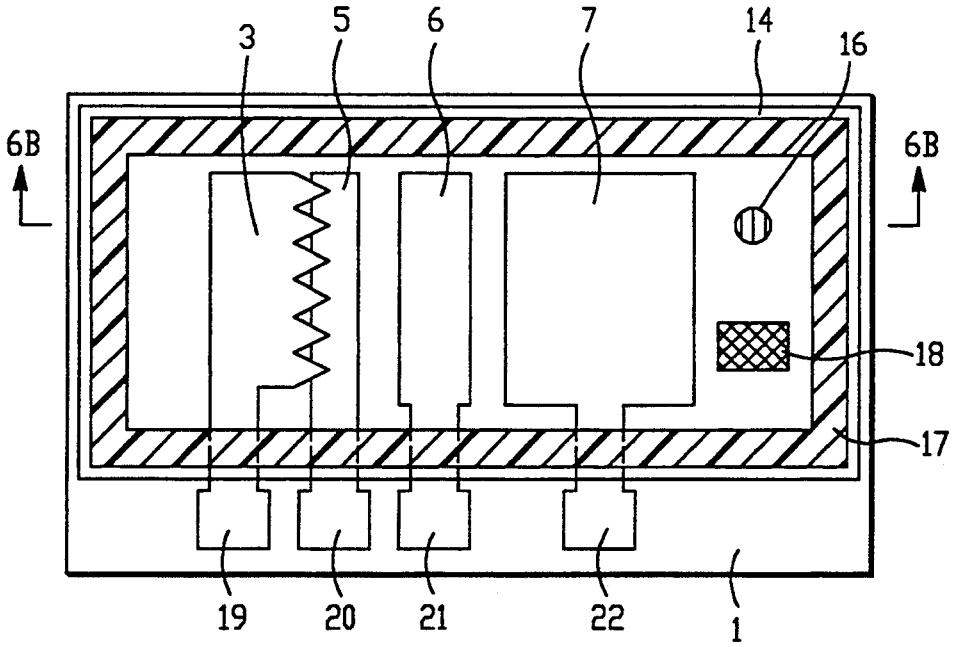
FIGS. 6A illustrates a flat tetrode vacuum tube employing the tetrode field electron emission device of FIG. 1.
Figure 6B:
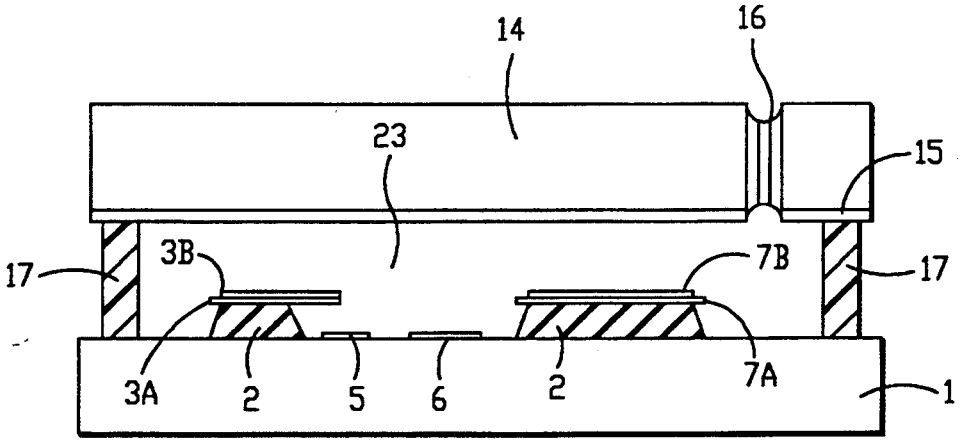
FIG. 6B is a cross section of the device of FIG. 6A taken along the line 6B—6B of FIG. 6A.

(6) FIG. 6A is a plan view of a flat tetrode vacuum tube employing the new tetrode field electron emission device described above. FIG. 6B is a cross sectional view along the line 6B—6B of FIG. 6A. The flat tetrode vacuum tube of FIG. 6A has a flat substrate or base 1, which has the tetrode field electron emission device described above, and opposite side substrate or base 14. These opposing substrates 1 and 14 are positioned substantially parallel to each other with the use of support 17 provided around their periphery to form a sealed vacuum chamber 23 with walls comprising flat substrate 1, opposite substrate 14, and side support wall 17. Opposite substrate 14 is made of a quartz substrate. On the interior surface of substrate 14 facing into vacuum chamber 23 is formed conductive thin film 15 for the purpose of preventing the accumulation of electrostatic charges. In addition, there is sealing port 16, which seals vacuum chamber 23 after it has been evacuated. Sealing port 16 is sealed off by melting an Au/Ns alloy within the port opening. The port opening initially has a Cr/Au thin film on its surface. Gettering material 18, comprising an Al/Ba thin film alloy is previously formed on the surface of opposite substrate 14. After vacuum layer 23 has been completed, it is heated with a laser, evaporating it on the walls of vacuum layer 23, reviving the gettering effect.

Side wall support 17 may be comprised of a baked mixture of low melting point glass powder and glass fibers having a diameter of about 100 μm. It seals and adheres well to both substrates 1 and 14 and maintains a uniform gap for vacuum chamber 23 at about 100 μm.

The external accessed pins of the tetrode field electron emission device, i.e., cathode pin 19, gate pin 20, control pin 21, and anode pin 22, extend outside of vacuum chamber 23 through flat substrate 1 and side wall support 17 by means of formed thin metal films. The size of the flat tetrode vacuum tube may be about 7 mm in length, 4 mm in height and 2.2 mm in thickness. Compared to the thermo-electronic emission type vacuum tubes of the prior art, it is very small, with a volume of 1/1000 or lower. The degree of vacuum in vacuum chamber 23 may be $1\times10^{-7}$ torr or lower.

In previous embodiments, anode 7 is shown formed on the surface of flat substrate 1. However, this is not necessary. For example, the anode may be formed on the surface of the opposite substrate 14. In this particular case, control electrode 6 may be placed within vacuum chamber 23 so that it is positioned between emission projections 4 and anode 7.

Figure 7:
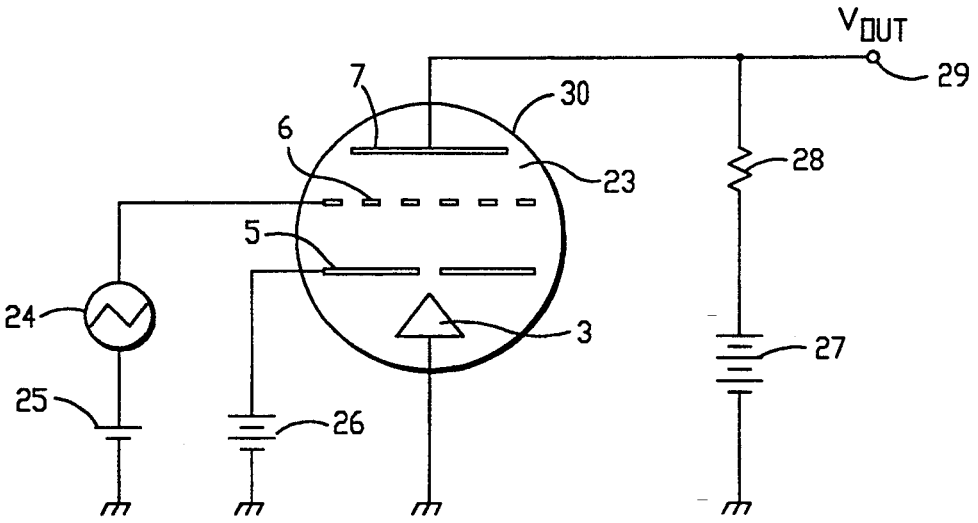
FIG. 7 is a schematic diagram of a cathode grounded device employing a tetrode field electron emission device of this invention.
Figure 8:
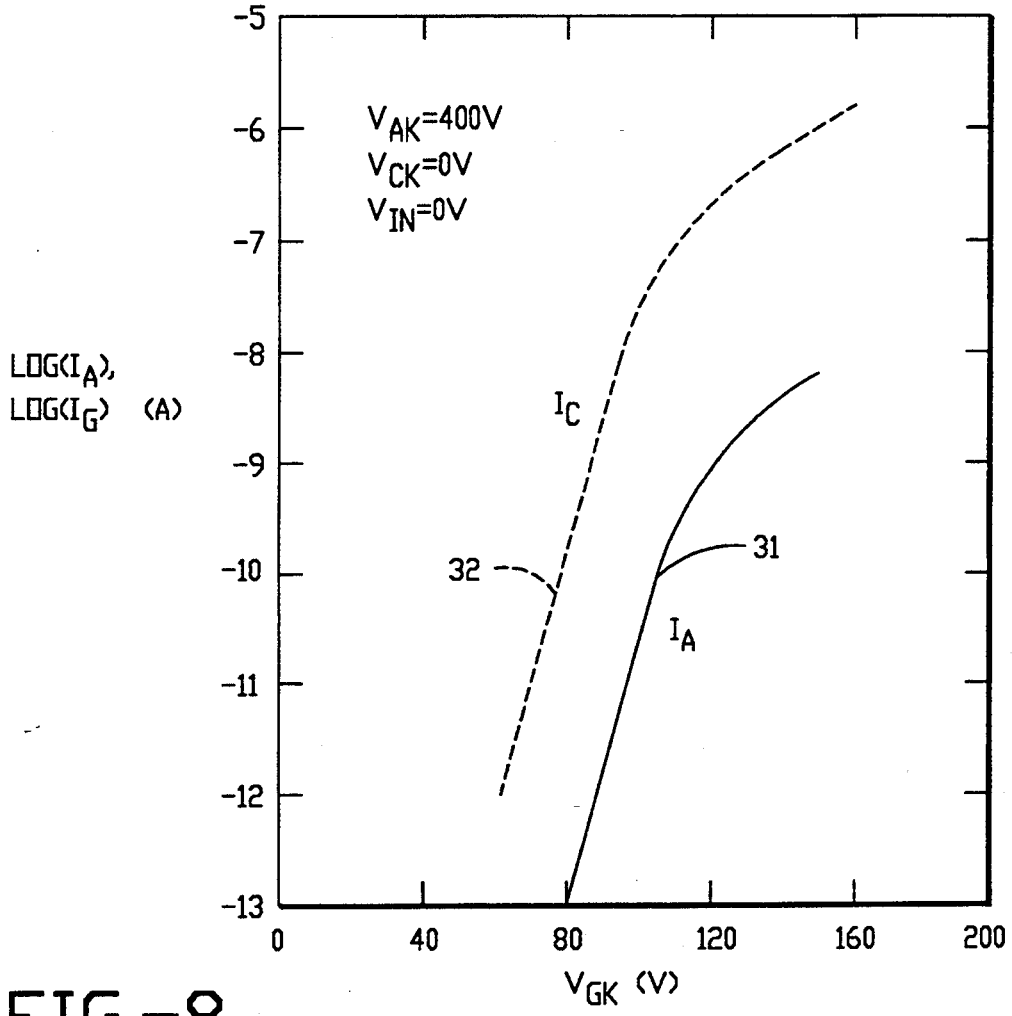
FIG. 8 is a graphic illustration of the electron emission characteristics of the cathode grounded device of FIG. 7.
Figure 9:
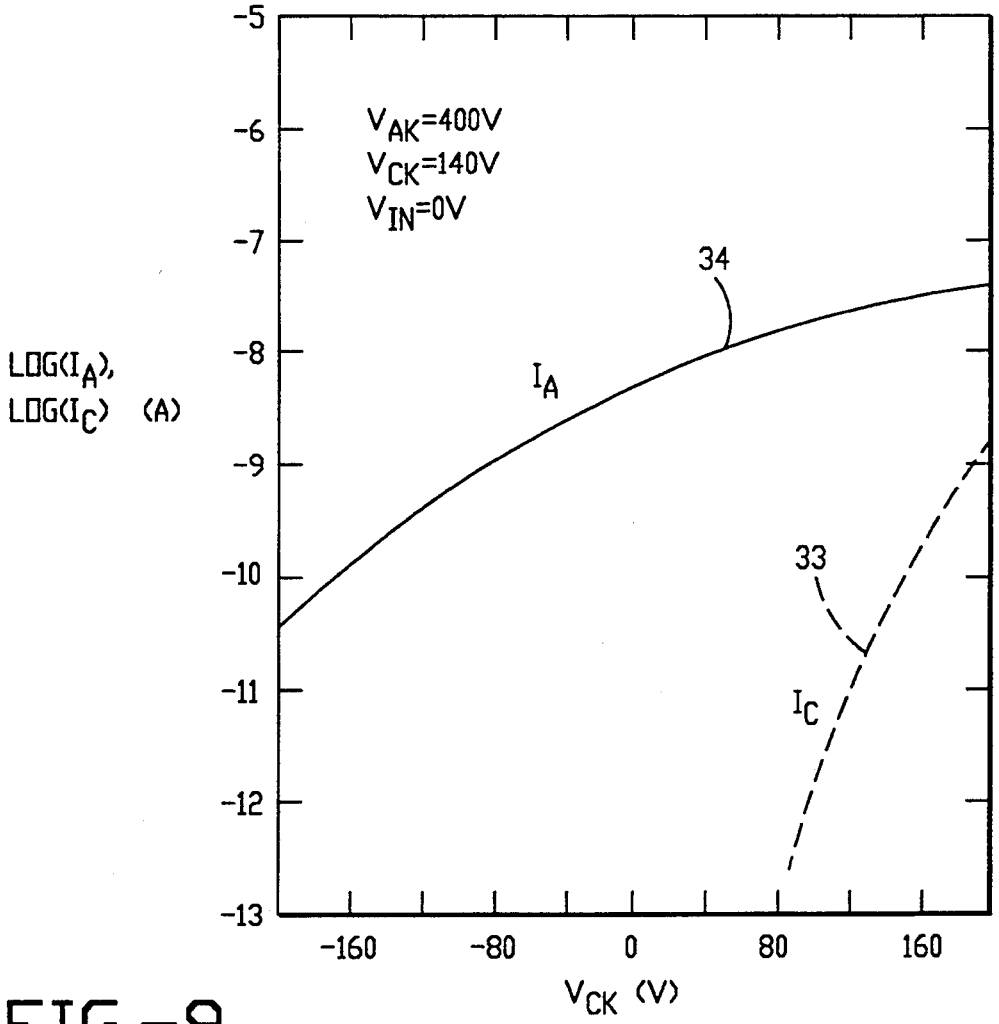
FIG. 9 is a graphic illustration of the input and output electrostatic characteristics of the cathode grounded device of FIG. 7.

FIG. 7 through FIG. 9 illustrate the electrical properties of the tetrode field electron emission device described above. FIG. 7 is a schematic diagram of a cathode grounded voltage amplifier employing the tetrode field electron emission device of this invention. The previously described tetrode vacuum tube is represented by symbol 30. This indicates that cathode 3, gate 5, control electrode 6, and anode 7 have been vacuum sealed within vacuum chamber 23.

The method of driving a voltage amplifier that employs a tetrode field electron emission device is as follows. Grounding cathode 3 is grounded and a positive bias gate voltage 26 ($V_{GK}$) applied to gate 5. A positive voltage 27 ($V_{AK}$) is applied to anode 7 through load resistance 28 ($R_L$). A superimposed control bias voltage 25 ($V_{CK}$) and input signal voltage 24 are applied to control electrode 6. An output signal voltage, $V_{out}$, is obtained at point 29, connected to anode 7 and load resistance 38, which is proportional to input signal voltage 24.

FIG. 8 is a graph showing the electron emission properties of the aforesaid tetrode field electron emission device. This is the result of measuring the dependence of gate current 32 ($I_G$) and anode current 31 ($I_A$) on gate voltage 26 of the tetrode field electron emission device. In this case, input signal voltage 24 and control bias voltage 25 are at zero volts in the electrical connection drawing in FIG. 7. Gate current 32 and anode current 31 increase exponentially relative to gate voltage 26, indicating that the emission current is the Fowler-Nordheim (F-N) tunnel current. Anode current 31 is about two digits smaller than gate current 32. In the driving method of the prior art, which controls anode current 31 with gate voltage 26, the electric power conversion efficiency was poor because $I_G>I_A$. In addition, because the transference characteristics are also exponential, it is difficult to use this method in a linear amplifier. For this reason, it came to be that anode current 31 is controlled by the voltage that is applied to control electrode 6.

FIG. 9 is a graph showing the input and output static characteristics of the aforesaid tetrode field electron emission device. This is the result of measuring the dependence of control current 33 ($I_c$) and anode current 34 on control bias voltage 25 of the tetrode field electron emission device. In this case, the gate voltage 26 is at $V_{GK}=140$ V, input signal voltage 24 is at zero volts and anode 27 is at $V_{AK}=400$ V for the device shown in FIG. 7. Although anode current 34 changes exponentially (non-linearly) in the range of $V_{CK}<0$, anode current 34 changes in a linear manner in the range of $V_{CK}>0$, i.e., in the range of $V_{CK}>0$, anode current 34 is proportional to the voltage applied to control electrode 6. Therefore, this device can be employed as a linear amplifier. Also, control current 33 is 1% or lower compared to anode current 34, yielding a field effect voltage amplifier with excellent input and output power conversion efficiency.

An anode 34 current control mechanism from the field effect of such a control electrode 6 is similar to the grid electrode of the thermo-electronic emission vacuum tube of the prior art, i.e., it is a mechanism in which anode current 34 is controlled by electric field in the form of a bias gradient formed between control electrode 6 and cathode 3 by means of bias control of electrode 6. If negative voltage is applied to control electrode 6 and a negative electric field is formed in the vicinity of emission projections 4, an opposing force is applied relative to emitted electrons traveling toward anode 7 and the number of electrons that reach anode 7 will be limited.

Since the electrons that are generated from the cathode have an initial escape velocity, they normally escape in the direction toward the anode. However, if a control electrode with a negative bias is interposed in an intermediate position between the cathode and anode, electron velocity can be reduced by the negative bias gradient of the control electrode, and actually some of the electrons return to the cathode. As a result, many of the electrons remain in a region between the cathode and the control electrode forming an electron cloud, i.e., a space charge limited region. Electrons that are able to continue toward the anode are statistically limited to those with energy levels higher than the control electrode bias. It is known that the travel of electrons in such a space charge limited region yields very low amounts of noise current. The fluctuation of the space charge is small compared to the emission current fluctuation (noise current) from the cathode. In particular, the fluctuation of electrons with a small amount of energy can be ignored. Only some of the electrons, those with a high level of energy, create noise in the anode current.

The triode field electron emission devices of the prior art do not have or contain this space charge control region. Most of the electrons that are emitted from the cathode are able to reach the anode in their travel through the radiation restricted region. Therefore, the emission current noise is expressed as the anode current noise.

However, if positive voltage is applied to control electrode 6, the strength of the repulsion force of the emitted electrons will weaken and anode current 34 will increase. Incidentally, positive bias gate electrode 5 performs the same role as the space charge grid electrode of the pentode vacuum tubes of the prior art and prevents the retention of a space charge in the area of cathode 3. As will be discussed later, in this invention, a control electrode has been added between anode 7 and control electrode 6 to prevent the effects of the secondary electrons from anode 7.

The linear and non-linear regions of the curve shown in FIG. 9 can be properly utilized by means of proper setting of control bias voltage 25. Operation along the linear region is suitable for a linear amplification function, such as, a voltage amplifier. Operation along the non-linear region is suitable for switching functions. Also, if gate voltage 26 is made small, control bias voltage 25, which provides the border line of the linear and non-linear areas, shifts to the low voltage side. Therefore, there are features, such as, being able to freely select the voltage setting of control bias voltage 25 by making settings as desired to gate voltage 26. However, as shown in FIG. 8, in the tetrode field electron emission device described above, the gate current is significantly higher than the anode current, and the parasite current that flows to the gate electrode is ineffective and not a problem.

Figure 10:
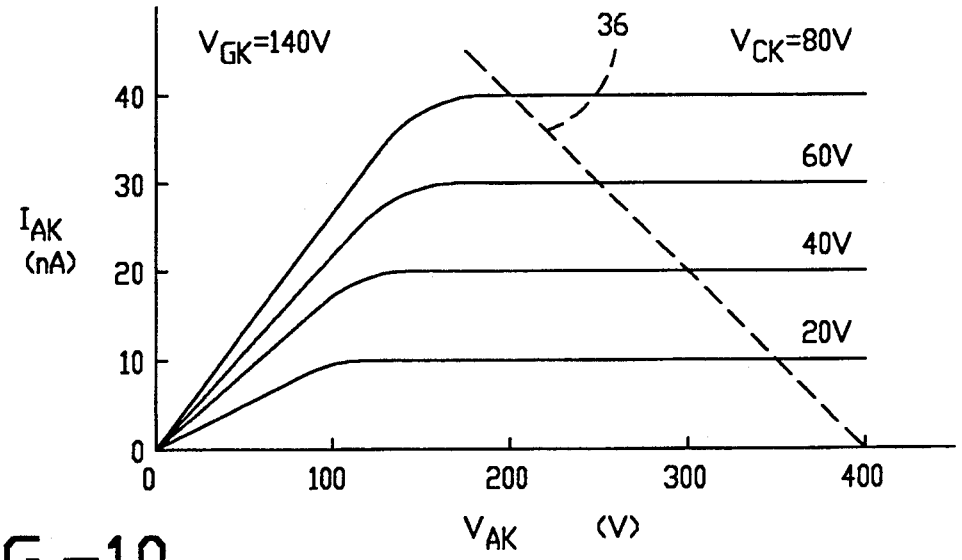
FIG. 10 is a graphic illustration of the anode electrostatic characteristics of the cathode grounded device of FIG. 7.

FIG. 10 is a graph illustrating the anode static characteristics of the multiple electrode field electron emission device of this embodiment. It is the result of measuring the $V_{AK}-I_{AK}$ static characteristics when the gate voltage is $V_{GK}=140$ V, input signal 24 is 0 V, and control bias voltage 25 is $V_{CK}=20$ V, 40 V, 60 V and 80 V in the electrical connection diagram in FIG. 7. As is understood from FIG. 10, in the multiple electrode field emission device of this embodiment, $I_{AK}$ becomes almost constant in the $V_{AK}>150$ V range. Also, $I_{AK}$ increases in proportion to $V_{GK}$, which is an anode static characteristic that is similar to the thermo-electronic emission pentode vacuum tube of the prior art. This characteristic is suitable for linear amplifier applications because the anode resistance is very large and the input and output provide a proportional relationship.

If the load resistance in FIG. 7 is $R_L=5$ G ohms, load line 36 in the anode electrostatic graphic illustration of FIG. 10 is realized. The basic functions have been confirmed to be those of an amplifier by means of such a circuit. In other words, when control bias voltage 25 was $V_{AK}-40$ V and a 20-volt sine wave ($V_{in}=20$ sin (wt) V) was applied as input signal 24, a 50 V sine wave ($V_{out}=-50$ sin (wt) V) was obtained as output signal 29. The voltage amplification ratio was confirmed as 2.5 times the amplification function. When the frequency, $\omega$, was enlarged and the frequency characteristics were measured as an amplifier, the cutoff frequency, $\omega_c$, was 100 MHz or higher.

Figure 11:
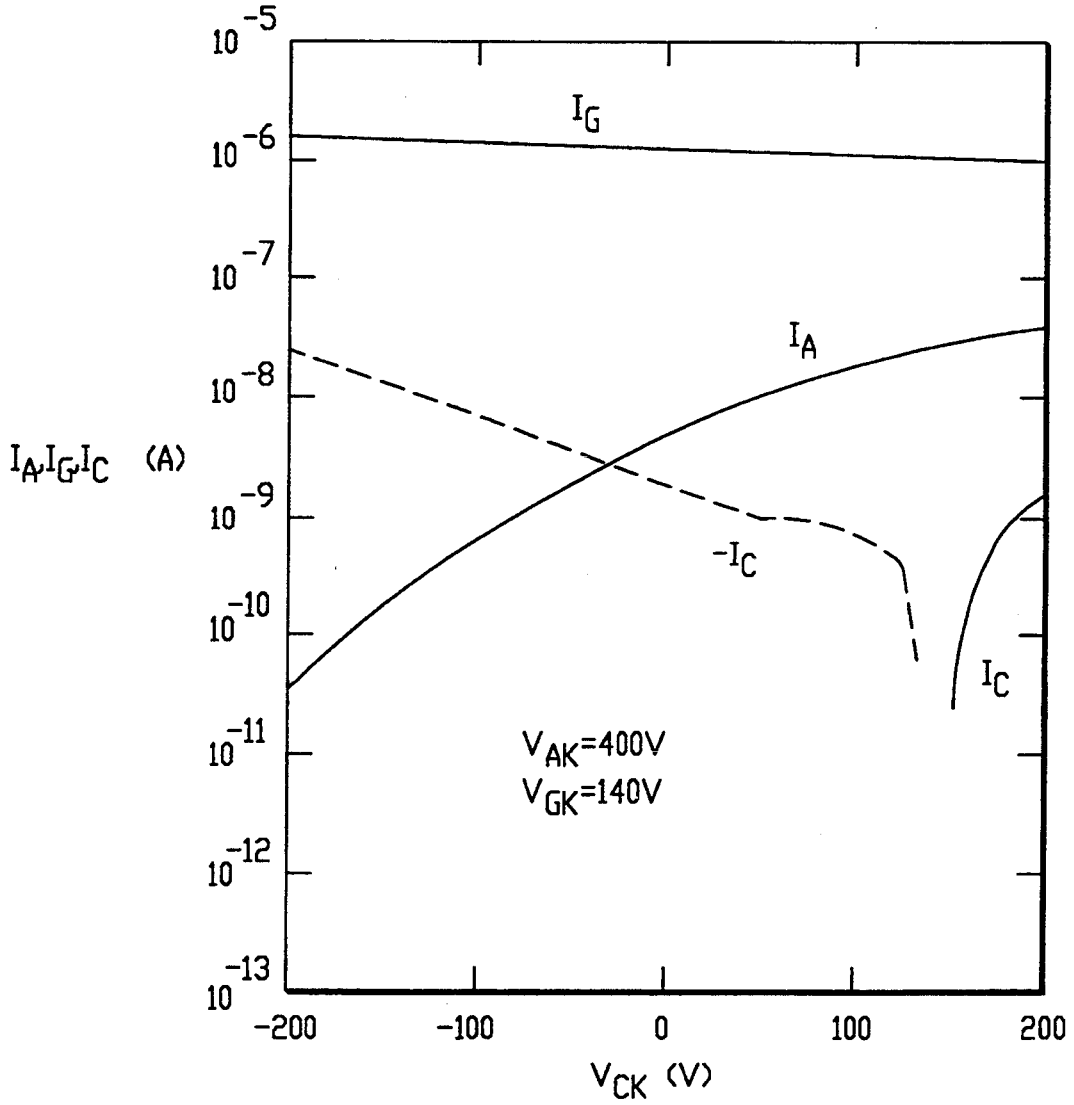
FIG. 11 is a graphic illustration of the relationship between gate current, anode current, and control current of the control electrode of a tetrode field electron emission device constructed according to the invention.

FIG. 11 shows the relationship of gate electrode $I_G$, anode current $I_A$, and control current $I_C$ to control voltage 25 ($V_{CK}$). When control current $I_C$ is $V_{CK}<V_{GK}$, $I_C<0$. Ion current in the vacuum and leak current on the surface of the substrate base are possible causes of negative current. However, because the current is stable, it is probably surface leak current between the gates. Anode current $I_A$ montonically increases in relation to control voltage $V_{CK}$. When the control voltage is very large, the anode current increases almost proportionally to the anode current. In other words, a linear region has been found for the transference characteristics. It has been discovered that radiation current is nearly constant relative to $V_{CK}$, and that this radiation current is determined by the gate current and is not influenced by the bias of other electrodes.

Figure 12:
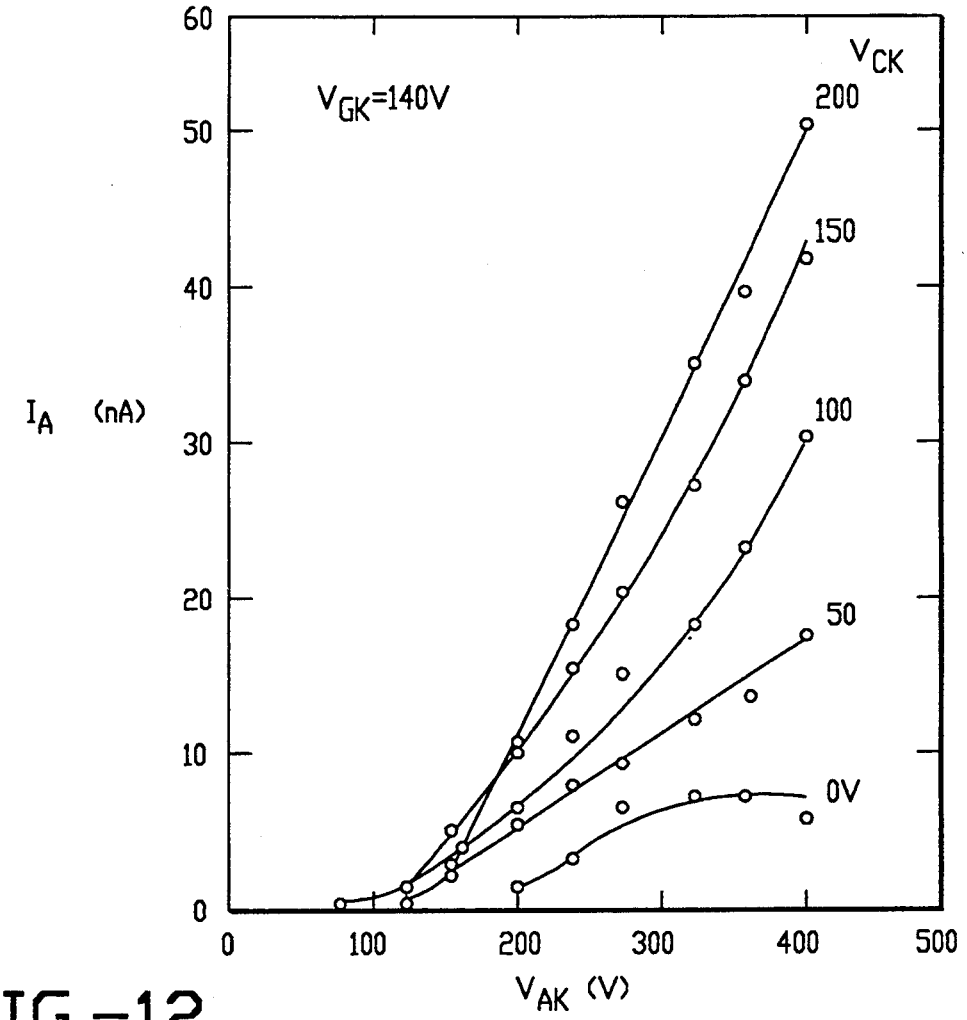
FIG. 12 is a graphic illustration of the anode characteristics of the tetrode field electron emission device of this invention.

FIG. 12 shows the control voltage $V_{CK}$ with the anode characteristics as the parameters. Anode current $I_A$ increases, with dependence on both anode voltage $V_{AK}$ and control voltage $V_{CK}$, and conforms to the following equation:

$$I_A=K(V_{CK}+V_{AK})^n$$

where K, and n are constants. The characteristics are the same as those for the thermo-electronic radiation triode vacuum tube in a space charge limited area. By estimating the amplification rate $\mu$ (=1/a) and the mutual conductance gm (=d $I_A$/d $I_{CK}$) from the same diagram, when $V_{AK}=330$ V and when $V_{CK}=150$ V, they are 1 and 2.6 E−10 S, respectively. The n value was about 1.3. When $V_{CK}>V_{GK}$, there is a tendency for some of the anode current to flow to the control electrode.

In the characteristics of FIG. 12, the values of gm and $\mu$ are very small. Practically, values of 1 mS or more and 100 or more are respectively demanded. There are a number of ways of improving both of these values. However, in the particular case of gm, it is effective to increase the radiation current.

In order to further increase the voltage amplification rate, increase the mutual conductance, and increase the frequency characteristics, it is necessary to either increase the number of cathode 3 emission projections or devise a structure for gate electrode 3 that reduces the number of ineffective gate electrodes while increasing the anode current. In the embodiment of FIG. 7, there are six emission projections 4. However, if, for example, this was increased 10,000 times and the emission current was increased 10,000 fold, the voltage amplification rate and the mutual conductance would increase approximately 10,000 fold, allowing the frequency characteristics to improve approximately 100 times. To decrease the amount of ineffective gate current, the probability of emitted electrons impacting with gate electrode 5 would be reduced by structuring gate electrode 5 so that it has a smaller width, or providing its structure to be at an inclined plane with an open angle in the direction of the projection of emission projections 4.

Figure 13:
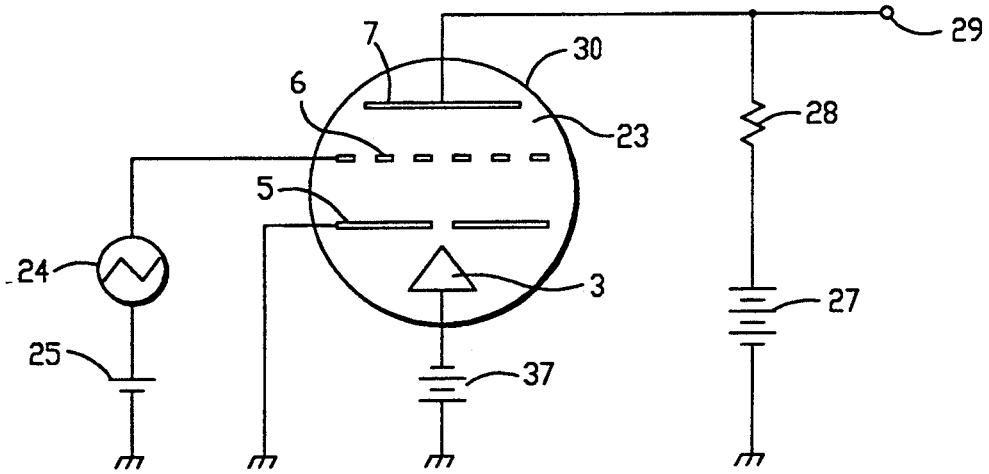
FIG. 13 is a schematic diagram of another tetrode field electron emission device constructed according to this invention.

In the embodiment of FIG. 7, the electrical connection method employed was to ground cathode 3. However, it should be understood that this is not the only configuration. For example, the connection method can be the grounding of gate electrode 5. FIG. 13 is a schematic diagram that utilizes the multiple electrode field electron emission device of the embodiment of FIG. 7 but has its gate electrode 5 ground thereby functional as a voltage amplifier. A negative voltage from cathode voltage 37 is applied to cathode 3. An amplifier is realized that is easy to employ because the border line of the linear region and the non-linear region do not fluctuate as a result of the emission current.

Figure 14:
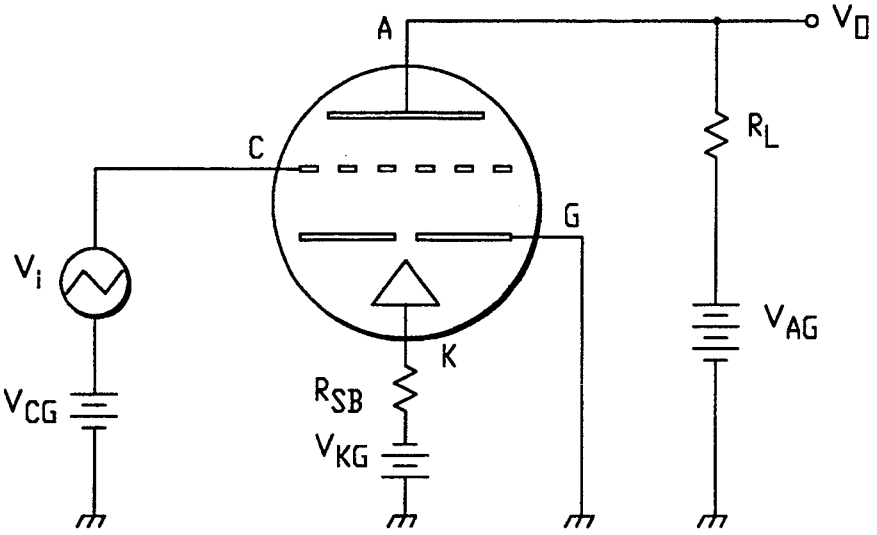
FIG. 14 is a schematic diagram of still another tetrode field electron emission device constructed according to this invention.
Figure 15:
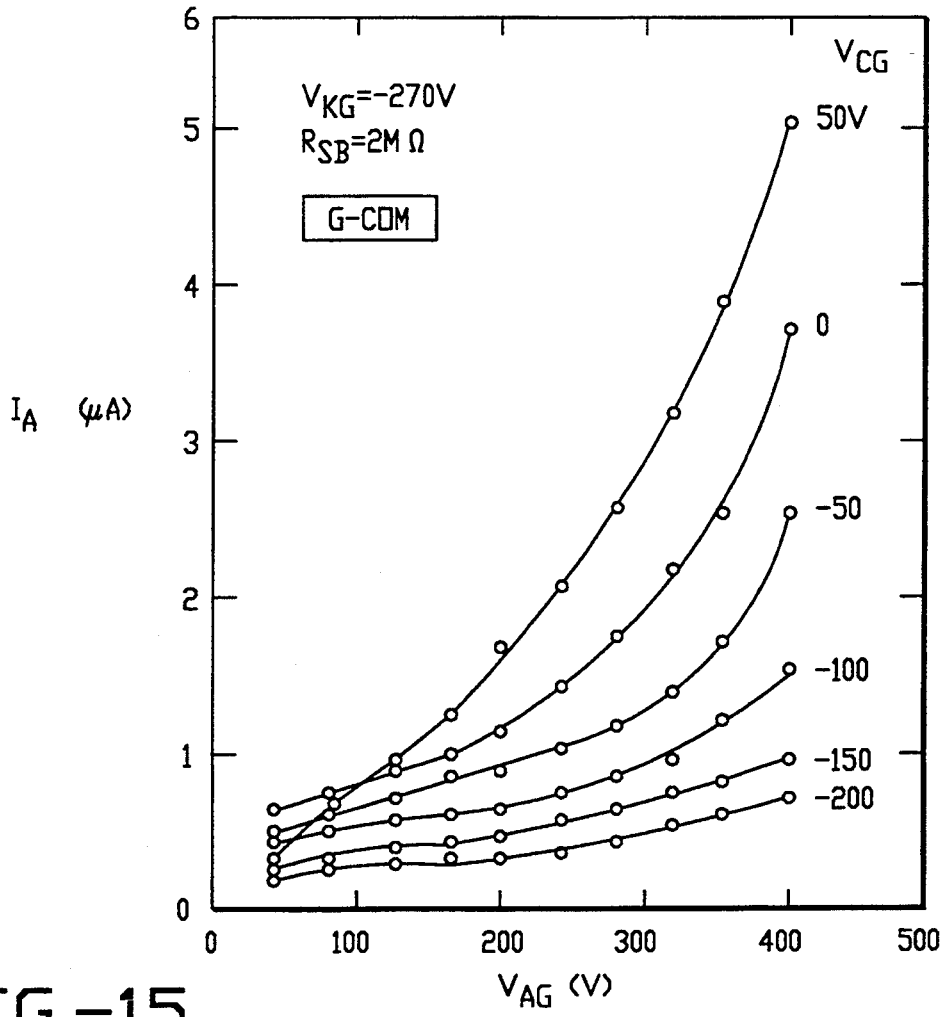
FIG. 15 is a graphic illustration showing the anode characteristics of the tetrode field electron emission device of FIG. 14.

With reference to the tetrode device shown FIG. 14, when the radiation current is large, it is possible to utilize a driving method having self-biasing resistance $R_{SB}$ between the cathode and the anode in order to achieve an emission current with little noise. FIG. 15 shows the anode characteristics for the device of FIG. 14. In the case where, a 2 megohm self-bias resistance $R_{SB}$ has been inserted in series with the cathode for stabilizing the emission current. When $V_{KG}=-270$ V, the emission current is 10 microamps. Based on these results, the values obtained were gm=10 nS and $\mu=1.5$.

The gm and $\mu$ characteristics have been summarized in Table 1 below. Relative to the tetrode devices, tetrode device A corresponds to FIG. 12 and tetrode device B corresponds to FIG. 15.

TABLE 1

| Device | | gm | $\mu$ | Transference Characteristics |
|---|---|---|---|---|
| Desired Characteristics | | >1 mS | >100 | Linear |
| Tetrode Device | A | 0.2 nS | 1 | Nearly linear |
| | | $V_{AG}=300$ V, $V_{CK}=150$ V, $I_E=1$ $\mu$A | | |
| Tetrode Device | B | 10.0 nS | 1.5 | Nearly linear |
| | | $V_{AG}=300$ V, $V_{CK}=-50$ V, $I_E=10$ $\mu$A | | |
| Triode Device | | 2.0 nS | >100 | Non-linear |
| | | $V_{AG}=300$ V, $V_{CK}=120$ V, $I_E=1$ $\mu$A | | |

Figure 16:
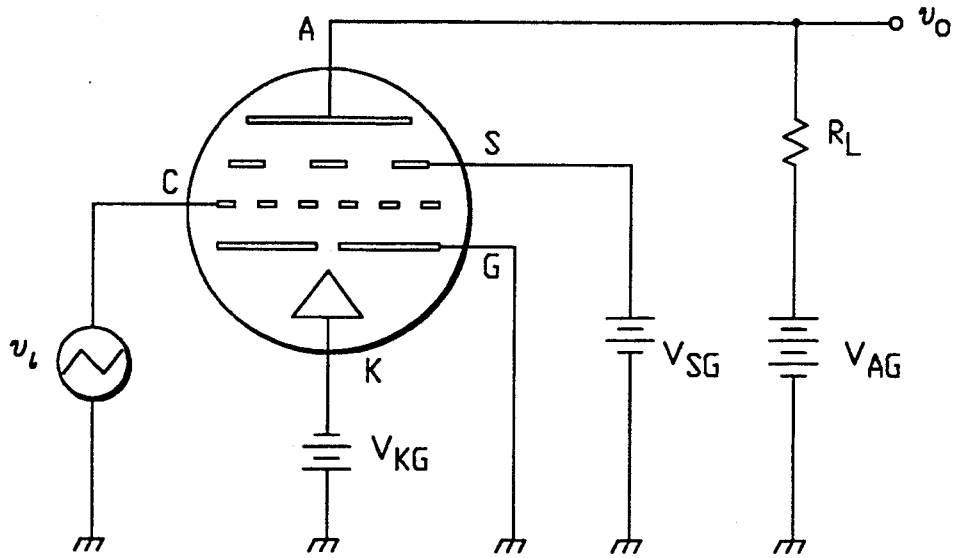
FIG. 16 is a schematic diagram of a pentode field electron emission device.
Figure 17:
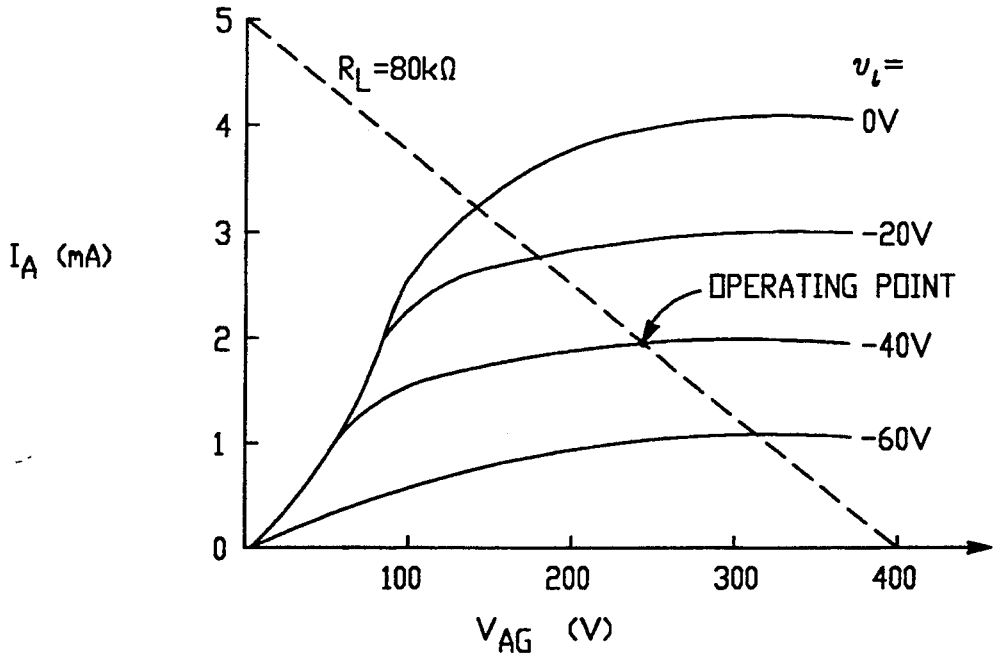
FIG. 17 is a graphic illustration of the anode characteristics of the pentode field electron emission device of FIG. 16.

FIG. 16 is a schematic diagram of a pentode field electron emission device, which includes, in addition relative to the previous described embodiment, a screen electrode S. FIG. 17 shows the anode characteristics for the pentode in FIG. 16. Measurements were made under the conditions wherein the number of cathode projections are 10,000, $V_{KG}=140$ V, cathode current $I_K=20$ mA. $V_{SG}=100$ V, and $R_L$, =1 kilohm. In FIG. 17, if a load of $R_L=80$ kilohms is applied, as illustrated by the dotted line in FIG. 17, the amplification rate is four fold with an operating point of $V_i=-40$ V. A pentode device is characterized by having an anode current not fluctuating because even if the anode current does change, the electric field near the control electrode will not change due to the existence of the screen electrode, S. In other words, the anode resistance $\gamma a$ increases according to the relationship:

$$\gamma a=\Delta V_A/\Delta I_A$$

Figure 18A:
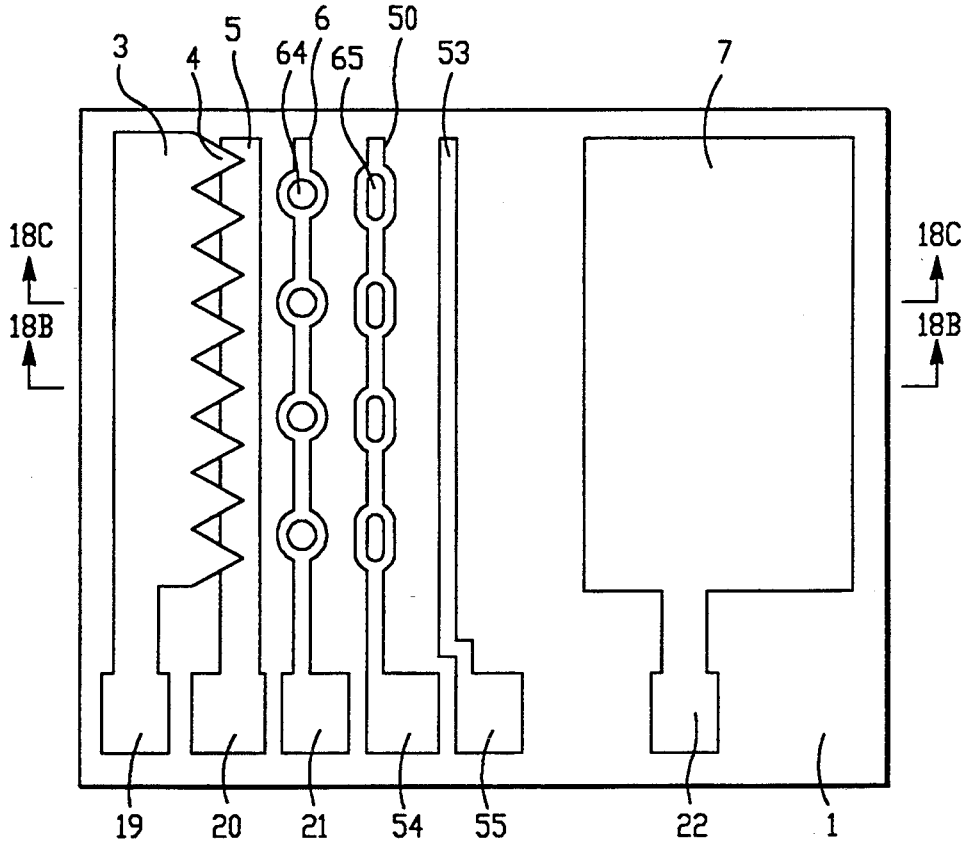
FIG. 18A is a schematic diagram of a hexode field electron emission device constructed according to this invention.
Figure 18B:
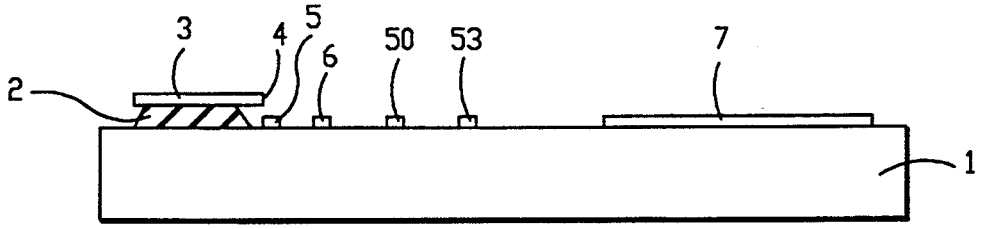
FIGS. 18B and 18C are cross sections of the device of FIG. 18A taken respectively along the lines 18B—18B and 18C—18C of FIG. 18A.
Figure 18C:
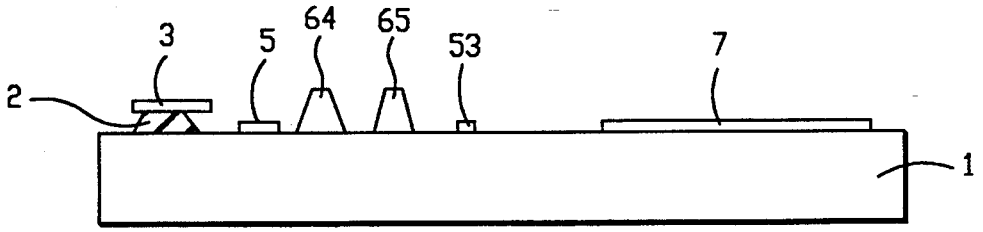

The next described embodiment comprises a hexode field electron emission device and its manufacturing process is also described. FIGS. 18A, 18B, and 18C are schematic diagrams of a fiat hexode field electron emission device comprising this invention wherein FIG. 18B is a cross sectional view taken along the line 18B—18B of FIG. 18A and FIG. 18C is a cross sectional view taken along the line 18C—18C of FIG. 18A. The hexode device includes spatially positioned control electrode 6 and anode 7 between which are formed screen electrode 50 and suppressor electrode 53. In addition, both control electrode 6 and screen electrode 50 include spatially formed columnar portions comprising columnar shaped control electrodes 64 and columnar shaped screen electrodes 65, which are respectively formed on top of control electrode 6 and screen electrode 50. These columnar shaped electrodes are formed so that they pierce or cross the fiat substrate by cathode 3, and their height is at least as high as, if not higher than, the film thickness of island shaped insulating layer 2.

As an example, columnar shaped control electrodes 64 have a column shape with a diameter of 3 $\mu$m and a height of 5 $\mu$m. The electrode pitch is 10 $\mu$m and is located about 10 $\mu$m away from emission projections 4 and are formed so as to be aligned between adjacently disposed emission projections 4. Columnar shaped screen electrodes 65 have an elongated shape, for example, with a length of about 5 $\mu$m, a thickness of about 3 $\mu$m and a height of about 5 $\mu$m. Each columnar shaped control electrode 64 has been positioned a distance of 10 $\mu$m away from one another. Suppressor electrode 53 may have a width, for example, of about 5 $\mu$m and is located between anode 7 and screen electrode 50. The distance of suppressor electrode 53 from screen electron 50 may be about 20 $\mu$m and from anode 7 may be about 50 $\mu$m.

Cathode 3 includes eight emission projections that are formed with a 5 $\mu$m pitch. The thickness of island shape insulating layer 2 is 5,000 angstroms. Gate electrode 5 is formed so that it self aligns with cathode 3. The distance from emission projections 4 is 3,000 angstroms. The width of the tip region is about 2 $\mu$m. The distance from the control electrode is 4 $\mu$m.

The electrons emitted from cathode 3, due to the electric field of gate electrode 5, is controlled by the electric field applied by control electrode 6, and this field limits the amount of electrons that are able to reach anode 7. Screen electrode 50 is maintained at a constant bias to prevent fluctuations of the electric field of control electrode 6 due to the electric field of anode 7. Suppressor electrode 53 prevents the secondary electrons generated by anode 7 from returning to toward control electrode 6. FIGS. 19A–19F is for the purpose of describing the manufacturing process of the hexode field electron emission device of the embodiment of FIGS. 18A–18C. The following is a description of the manufacturing process in conjunction with FIGS. 19A–19F.

Figure 19A:
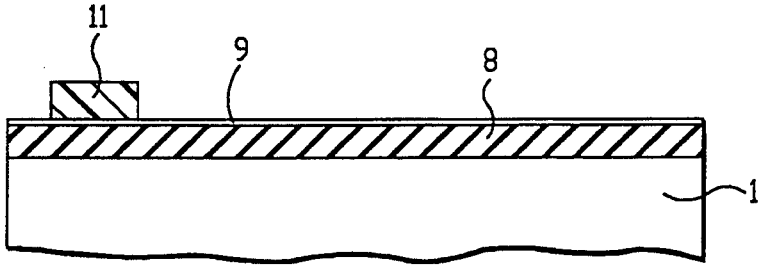
FIGS. 19A–19G is a series of figures illustrating the steps of manufacture for the hexode field electron emission device of FIG. 18.

First, insulating layer 8 and cathode 9 are sequentially formed on the surface of flat substrate 1. Then, photoresist layer 11 is formed as illustrated in FIG. 19A. Photoresist layer 11 is utilized for forming cathode 3. Flat substrate 1 may be made of alumina. Because a ceramic substrate, such as an alumina substrate, is highly insulating and has a large thermal conductance ratio, it is excellent as a substrate base for a field electron emission device for handling a large amount electric power. Alternatively, a semi-insulating GaAs substrate base and a diamond substrate base may be employed for substrate 1. Insulating layer 8 may be a 5,000 angstrom thick silicon dioxide thin film. Cathode 9 may be a 1,000 angstrom thick tantalum (Ta) thin film.

Figure 19B:
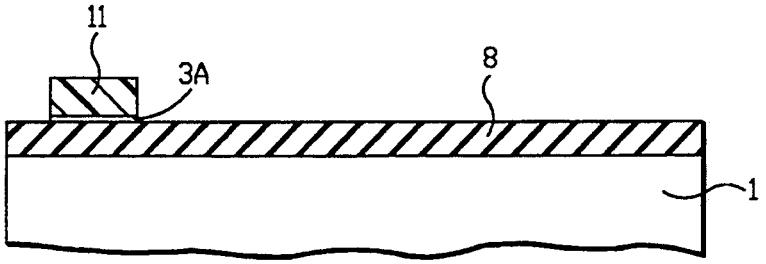

Next, cathode layer 9 is formed by means of extended etching to form first cathode 3A, shown in FIG. 19B. Dry etching may be employed as the means to achieve extended etching. After extended etching in $CF_4/O_2$ gas=120/100 and at RF power 700 watts for 25 minutes, cathode 9 is extended etched to 1 $\mu$m to form emission projections 4 having a tip curvature radius of 300 angstroms.

Figure 19C:
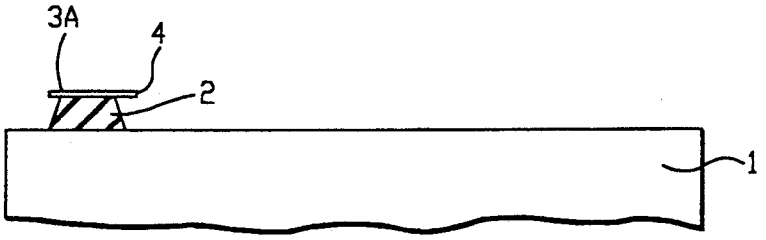
Figure 19D:
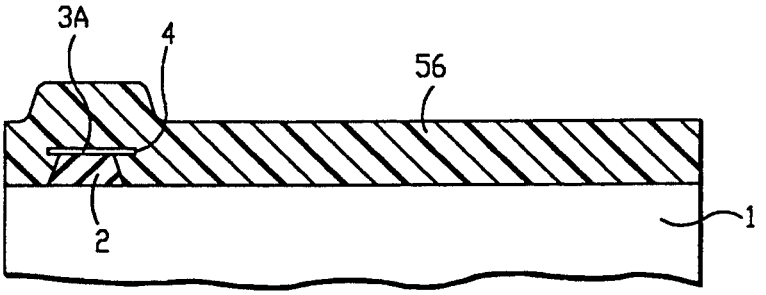

Next, insulating layer 8 is selectively etched in portions to form island shaped insulating layer 2 and to remove photoresist layer 11, as indicated in FIG. 19C. The method of forming insulating layer 2 is the same as that described in connection with prior embodiments.

Next, columnar forming layer 56 is formed as indicated in FIG. 17D. Columnar forming layer 56 may be a photosensitive polyimide resin, e.g., negative type PI-410 manufactured by Ube Kosan, of about 5 μm in thickness which is formed by means of coating. Alternatively other types of organic materials may be employed and, further, inorganic materials may be employed for columnar forming layer 56.

Figure 19E:
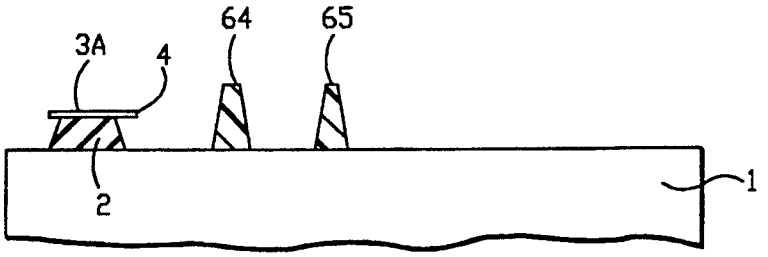

Next, columnar forming layer 56 is selectively photoetched to form control electrodes 64 and screen electrodes 65 as indicated in FIG. 19E. If columnar forming layer 56 is itself of a photosensitive material, the layer can be selectively processed to form these electrodes by means of photo-etching. If the material employed for layer 56 is organic material or inorganic material, alternatively, an anisotropic etching method, such as, RIE (reactive ion etching), may be employed.

Figure 19F:
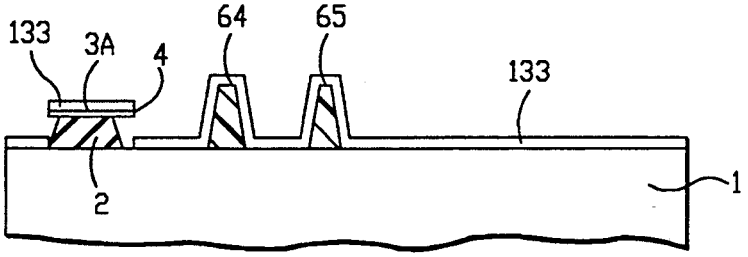

Next, gate electrode layer 133 is formed using directional particulate deposition and is shown in FIG. 19F. The directional particulate deposition method is sputtering. Gate electrode 133 may be comprised of tantalum (Ta) with a film thickness of 2,000 angstroms. Gate electrode 133 covers control electrodes 64 and screen electrodes 65 and is also deposited on the side surfaces of these electrodes as well.

Figure 19G:
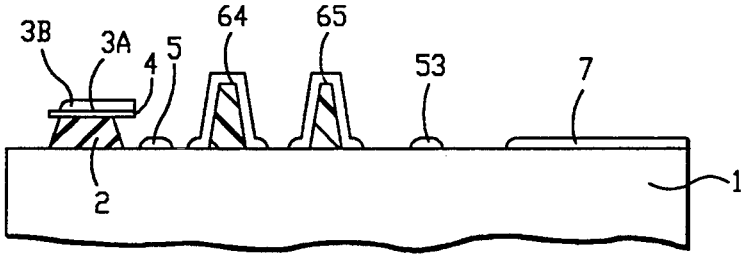

Finally, gate electrode layer 133 is selectively etched to form second cathode 3B, gate electrode 5, control electrode 6, columnar shaped control electrodes 54, screen electrode 50, columnar shaped screen electrodes 65 and suppressor electrode 53 as shown in FIG. 19G.

In the case where columnar shaped control electrodes 64 and column shaped screen electrodes 65 are comprised of an organic material, they cannot be utilized in a high vacuum condition and so are removed leaving the material formed by the gate electrode layer 133. The method of their removal is as follows. First, the surface of flat substrate 1 is coated with resist material. At this time, the thickness of the resist formed at the tips of columnar shaped control electrodes 64 and columnar shaped screen electrodes 65 is thinner compared to other areas of these electrode structures. Then, this resist material is removed by means of dry etching and the tips of columnar shaped electrodes 64, 65 and gate electrode layer 133 will first appear. When gate electrode layer 133 is completely removed by etching in the regions shown in FIG. 19F, apertures are formed in and through the tips of each electrode 64, 65. Finally, the remaining organic material within the confines of the electrode columns is removed by use of a solvent. Because the columnar shaped electrodes produced in this manner are hollow and no longer have organic materials contained within their structures, there is no problem that this organic material becomes a source of outgassing in a high vacuum state so that a high vacuum condition can be created within the device vacuum chamber by exhausting the chamber followed by proper hermetic sealing thereof.

Figure 20:
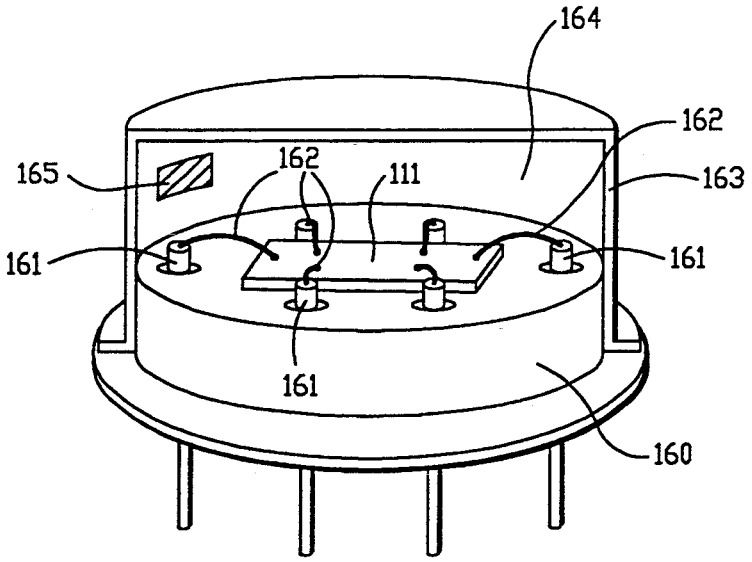
FIG. 20 is a perspective view of a hexode vacuum tube employing the hexode field electron emission device of FIG. 18.

FIG. 20 is a perspective view of a hexode vacuum tube having a hexode field electron emission device structure of the type just described in conjunction with FIGS. 18 and 19. In the embodiment of FIG. 20, the hexode field electron emission device is vacuum packed into a metal can. Flat substrate 111 which supports the hexode field electron emission device is fixed in place by a hermetic seal. Wires 162 connect each electrode to a hermetic pin 161. Hermetic seal 160 and cap 163 are sealed in a vacuum to form vacuum chamber 164. In order to continue to maintain a high vacuum condition, gettering material 165 is formed on the inner wall of cap 163.

Figure 21:
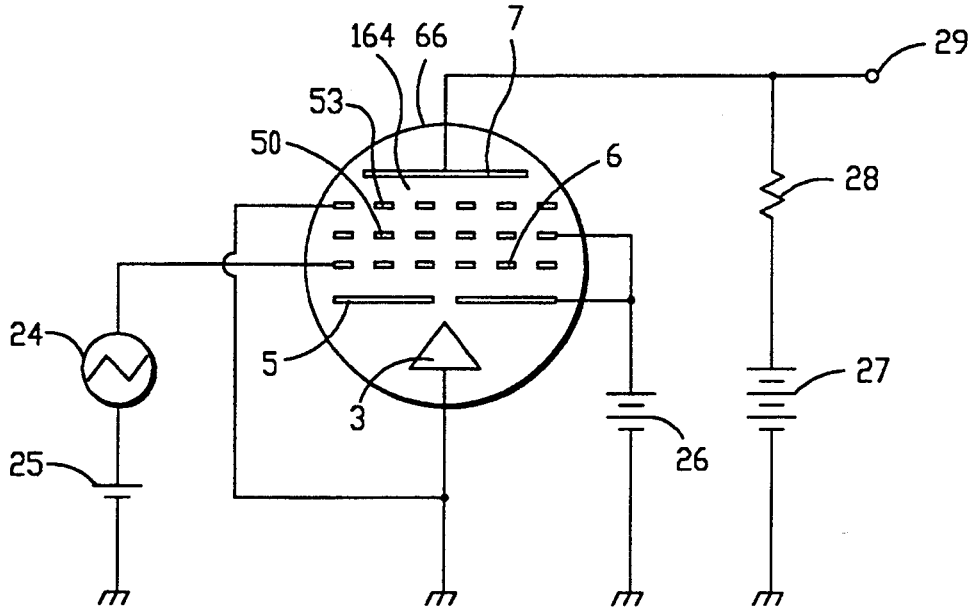
FIG. 21 is a schematic diagram of a hexode field electron emission device constructed according to this invention.

FIG. 21 is a schematic diagram of a cathode grounded type voltage amplifier employing the hexode field electron emission device described in conjunction with FIGS. 18 and 19. The hexode vacuum tube of FIG. 18 is indicated symbol 66 so that cathode 3, gate electrode 5, control electrode 6, screen electrode 50, suppressor electrode 53 and anode 7 are all vacuum sealed within vacuum chamber 164. Cathode 3 and suppressor electrode 53 are both grounded. A positive bias gate voltage 26 is applied to gate electrode 5. A superimposed control bias voltage 25 and input signal voltage 24 are applied to control electrode 6. An anode voltage 27 is applied to anode 7 through load resistance 28. A desired positive bias is be placed on screen electrode 50. However, for the sake of simplicity, in terms of the number of power supply sources and the numbers of lines, the bias on screen electrode 50 is made the same bias as that for gate electrode 5, i.e., equal to $V_{GK}$. It is possible for the connection of cathode 5 and suppressor electrode 53 and gate electrode 5 and screen electrode 50 to be provided on the surface of flat substrate 1 or inside of vacuum chamber 164. Although this is a hexode type of device, as connected, the number of pins and the number of power supplies are the same as the previously described tetrode vacuum tube.

The method of driving the hexode field electron emission device is as follows. First, if a constant gate voltage 26 is applied to gate electrode 5, a constant or steady state amount of electrons will be emitted or ejected from cathode 3. As long as gate voltage 26 does not change, the volume of ejected electrons remains constant. In this condition, with anode voltage 27 constant, if input signal 24, which has direct current bias, is applied to control electrode 6, the anode current is controlled in proportion to input signal 24 and output signal voltage 29, which is amplified through load resistance 28. The field effect of the electrons of control electrode 6 will be the same as the effect described in connection with previous embodiments. Screen electrode 50 prevents field fluctuations due to voltage fluctuations in the vicinity of control electrode 6. It also has the function of improving the anode resistance and the frequency characteristics. Suppressor electrode 53 prevents the secondary electrons generated by anode 7 from flowing in toward or to control electrode 50.

When the hexode field electron emission device is driven at $V_{AK}=300$ V, $V_{GK}=160$ V, $V_{KG}=60$ V, and $R_L=1$ gigohm, a voltage amplification rate of $\mu=8$ is achieved. In this case, the mutual conductance gm is equal to $2\times10^{-9}$. The frequency characteristics are improved two fold compared to the tetrode field electron emission device described in the previous embodiment. This is believed to be due to the anode screening effect of screen electrode 50.

Figure 22:
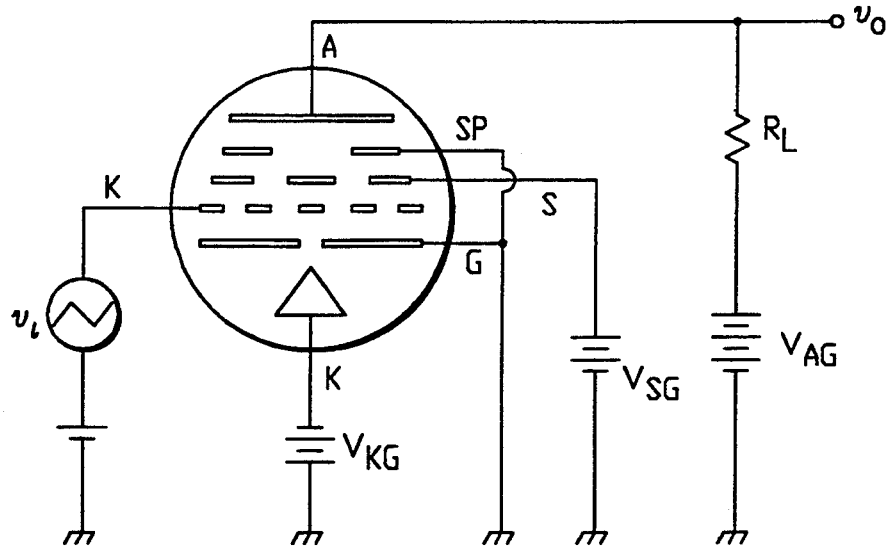
FIG. 22 is another schematic diagram of a hexode field electron emission device constructed according to this invention.
Figure 23:
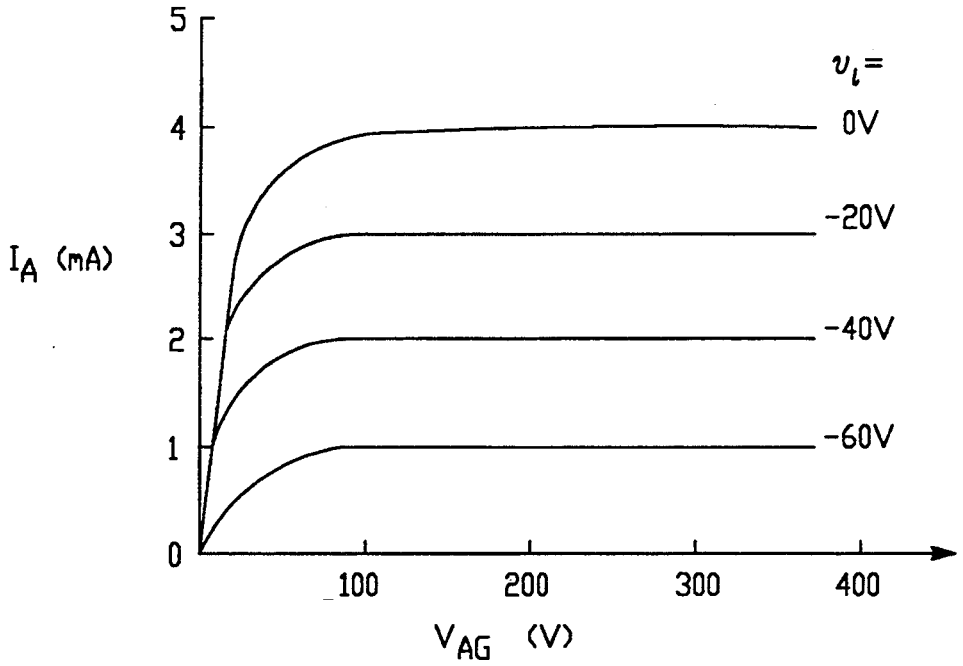
FIG. 23 is a graphic illustration of the anode characteristics of the cathode grounded device of FIG. 22.

FIG. 22 shows another schematic diagram of the hexode field electron emission device. FIG. 23 is a graph showing its anode characteristics, which was measured under the conditions of 10,000 cathode emission projections, $V_{KG}=-140$ V, cathode current, $I_K$=20 mA, $V_{SG}$=100 V and $R_L$=1 kilohm. As is clear from comparison of FIG. 23 and FIG. 17, the anode resistance further increases due to the presence of the suppressor electrode, and saturation properties are indicated even if $V_{AG}$ is small. The anode resistance was $\gamma a$=8 MΩ.

This invention does not only apply to the flat devices described above. It can also apply to vertical devices. As one example, a vertical tetrode field electron emission device formed on a silicon single crystal substrate will be described in this embodiment.

Figure 24:
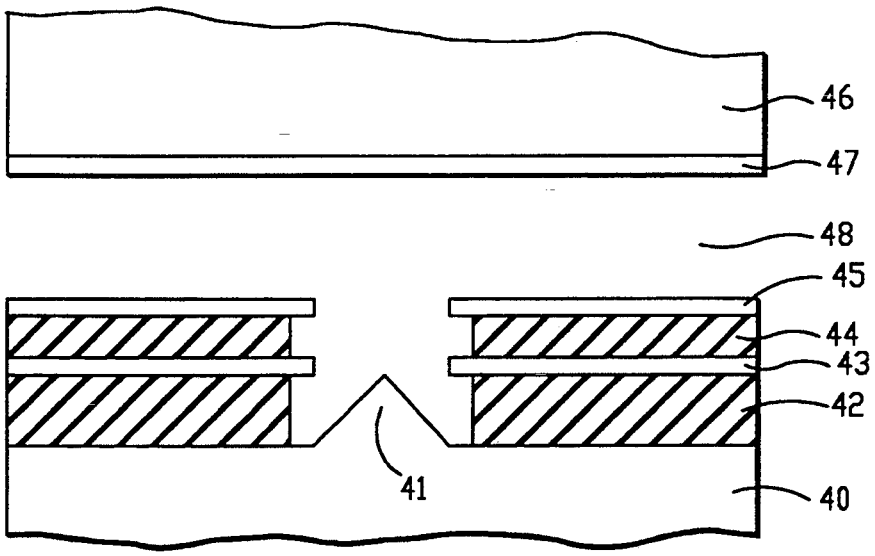
FIG. 24 is a cross sectional view of a vertical tetrode field electron emission device constructed according to this invention.

FIG. 24 is an illustration of this invention in the form of a vertical tetrode field electron emission device. The device generally comprises a conductive flat substrate 40, for example, of an n-type single crystal silicon substrate with a (100) surface; cathode 41, formed on the surface of flat substrate 40, which has a pointed shape projecting upward in a vertical direction; first insulating layer 42, formed on the surface of flat substrate 40 and removed from around the circumference of cathode 41; gate electrode 43, formed on the surface of first insulating layer 42 and removed from around the circumference of cathode 41; second insulating layer 44, formed on the surface of gate electrode 43 and removed from around the circumference of cathode 41; control electrode 45, formed on the surface of second insulating layer 44 and removed from around the circumference of cathode 41; and opposite substrate 46, on which is formed anode 47, which is located on the inside surface of substrate 46 facing into vacuum region 48 in opposed relation to control electrode 45.

Figure 34A:
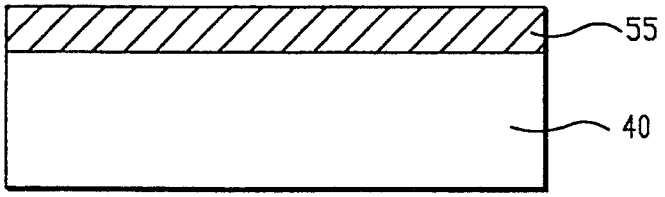
FIG. 34A–34J is a series of cross sectional illustrations of a method for forming the structure of FIG. 1.
Figure 34B:
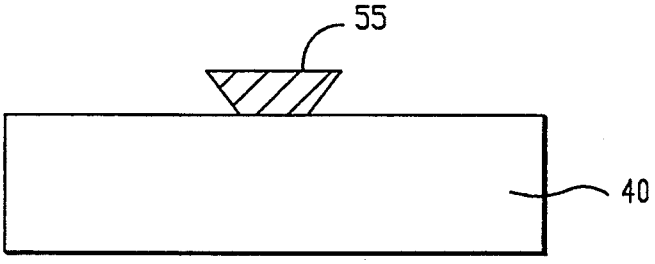

The vertical tetrode field electron emission device of FIG. 24 is typically manufactured using the procedure or steps illustrated in FIGS. 34A–34J. As shown in FIG. 34A, the silicon substrate 40 is first covered with a thin layer of silicon dioxide which is subsequently patterned and wet etched to form a small, generally circular, mask layer 49 covering the substrate 40 in a location desired for the cathode 41 (FIG. 34B). The wet etching of the mask layer forms a reverse taper or recessed slope which makes the mask layer narrow adjacent to the substrate which allows some access to the surface of the substrate under the mask layer during subsequent processing steps. That is, the mask layer 49 overshadows or covers a larger portion of the substrate but does not completely prevent interaction of etching with substrate 40 over a portion of this area.

Figure 34C:
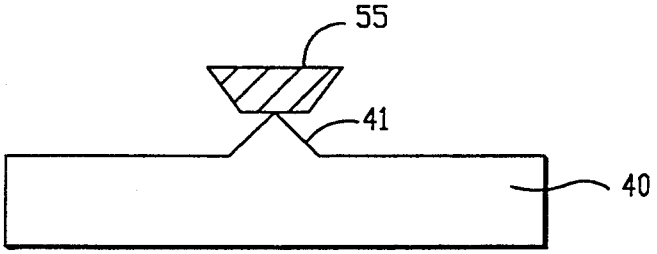
Figure 34D:
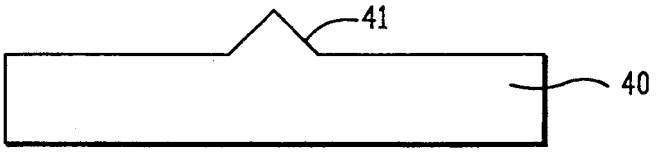

Anisotropic etching of substrate 40 is carried out using material such as a solution of KOH:IPA:H2O, see FIG. 34C, after which the silicon dioxide mask layer is removed, see FIG. 34D. The result of the anisotropic etching of flat substrate 40 is a conical shaped anode 41 projecting from the surface of the substrate 40. As shown in FIGS. 34C and 34D, the plumb axis of cathode 41 is perpendicular to the surface of flat substrate 40 and has a height of about 1.2 μm. Its cross sectional apex angle is about 90 degrees.

Figure 34E:
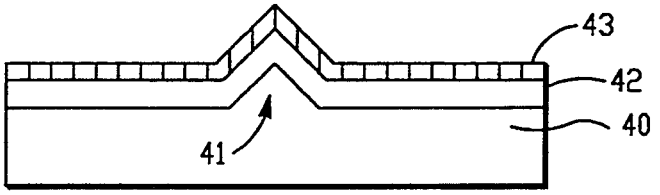
Figure 34F:
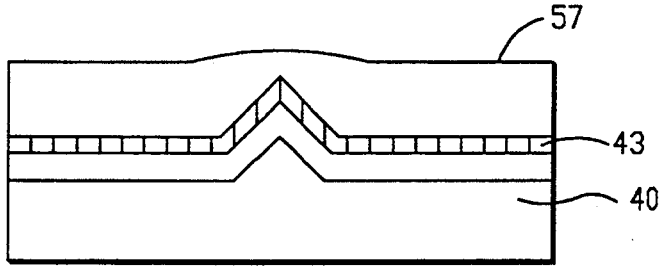
Figure 34G:
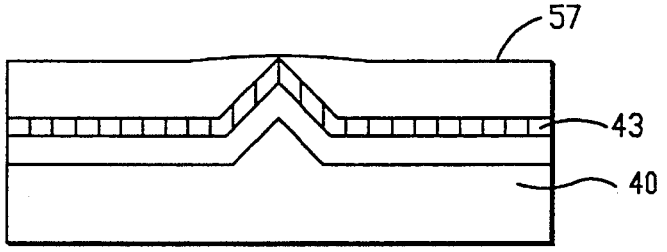
Figure 34H:
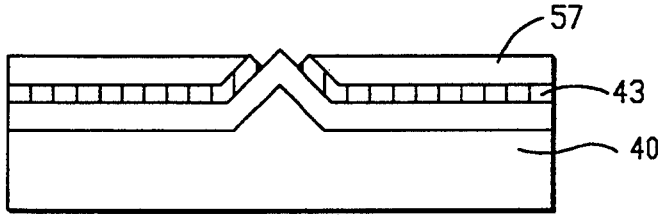
Figure 34I:
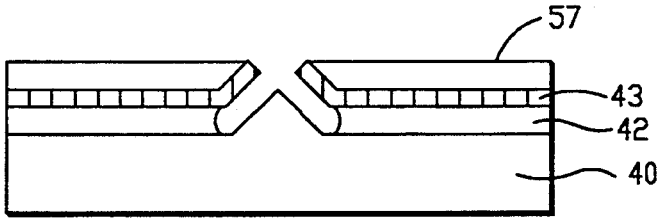
Figure 34J:
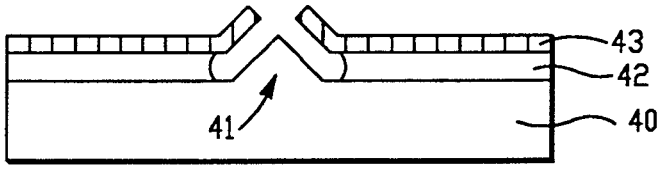

Turning to FIG. 34E, at this point, a layer of silicon diode is deposited on substrate 40 to form first insulating layer 42, followed by a thin film of molybdenum for gate electrode 43. A layer of resist material 55 is deposited across the molybdenum surface, typically using spin coating techniques, see FIG. 34F, and plasma etched using $CF_4/O_2$ until sufficient resist 55 and a portion of the molybdenum 43 are removed to expose the silicon dioxide material of insulating layer 42 as seen in the steps of FIGS. 34G and 34H. Wet etching of the insulating layer 42 is performed to remove material and form the under-cut or recessed region between cathode 41 and gate electrode 43 shown in FIG. 34I, after which the remaining resist is removed resulting in the structure of FIG. 34J.

In the alternative, cathode 41 may be formed by other methods of fabrication, for example, by using the Spindt type method as discussed in "Physical Properties of Thin-Film Field Emission Cathodes With Molybdenum Cones," by C. A. Spindt, et al., *Journal of Applied Physics*, Vol. 47, No. 12, December 1976, pages 5248–5263. First insulating layer 42 and second insulating layer 44 may be made of silicon dioxide thin film having respective thicknesses of 6,000 angstroms and 3 microns. The diameter of the openings formed in both insulating layers are approximately the same, e.g., 3 μm. Gate electrode 43 and control electrode 45 may be made from molybdenum with respective film thicknesses of 2,000 angstroms and 3,000 angstroms. The diameter of the opening forming each electrode 43 and 45 may be the same, e.g., about 1.2 μm. Flat substrate 40 and opposite substrate 46 are supported relative to each other by means of a side wall support, as explained in the case of previous embodiments, from vacuum chamber 48. The spatial depth of vacuum region 48 may be 50 μm. Anode 47 may be a transparent conductive film, such as, a thin aluminum film.

The operating functions of the tetrode field electron emission device of FIG. 24 are as follows. Relative to cathode 41, when a positive bias is applied to gate electrode 43, electrons are ejected from the projecting tip of cathode 41. These emitted electrons pass through the openings forming gate electrode 43 and control electrode 45 and arrive at anode 47. However, the amount of electrons, i.e., the anode current, that are able to reach anode 7 can be controlled by the bias voltage placed on control electrode 45. The anode current control due to the field effect of control electrode 45 functionally operates in the same manner as control electrode 6 in FIG. 1. Therefore, a linear region exists wherein the applied voltage of control electrode 45 and the anode current are proportional to each other. In other words, when the voltage of control electrode 45 is sufficiently negative, a negative bias gradient is created out from control electrode 45 in a direction toward cathode 41 and the ejected electrons are bounced back in a direction toward gate electrode 43. In such a situation, therefore, the anode current is small. However, when the voltage of control electrode 45 is sufficiently, a positive bias gradient is created so that any electrons will pass beyond control electrode 45 toward anode 47 creating a large anode current.

The electrical operating characteristics of a tetrode field electron emission device of the embodiment of FIG. 24 were measured using an emission device having 10,000 cathodes 41. In a circuit configuration where the cathode is grounded, with an applied gate voltage of 120 V, an anode current of 3 mA was obtained. The change in the anode current relative to the voltage applied to control electrode 45, i.e., the mutual conductance, was gm=20 μS. The parasitic current that flowed to gate electrode 43 was one percent or less indicating the excellent characteristics that are achieved.

If a screen electrode and a suppressor electrode are utilized in the tetrode field electron emission device of FIG. 24, its electrical operating characteristics can be improved. Also, in the foregoing embodiment, anode 47 is formed on the inner surface of an opposing substrate 46. However, alternatively, anode 47 may be formed on an extension of insulator 44 or on the flat surface of substrate 40.

Figure 35:
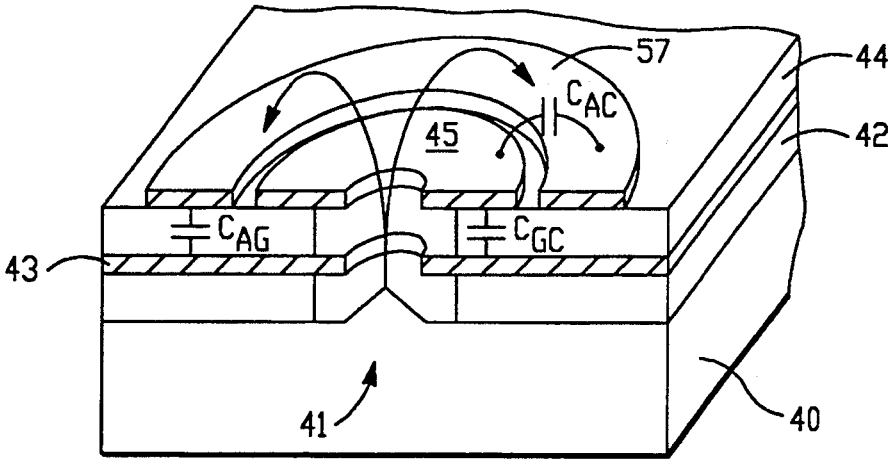
FIG. 35 is a perspective cross sectional view of a vertically formed emission device.

An example of the first structure is illustrated in FIG. 35, where the area of insulating material 44 is extended laterally but the area of electrode 45 is not. That is, control electrode 45 is formed as an annular electrode of predetermined size on the surface of second insulating layer 44, which is in turn formed on the surface of gate electrode 43, as before. The anode for this embodiment of the emission device is constructed as an annular electrode, or a layer with a hole for accommodating electrode 45, surrounding and spaced apart from control electrode 45. In this configuration, electrons from cathode 41 flow through an annular passage created in the electrode and insulating material layers and arch over to the surrounding anode 57.

Figure 36:
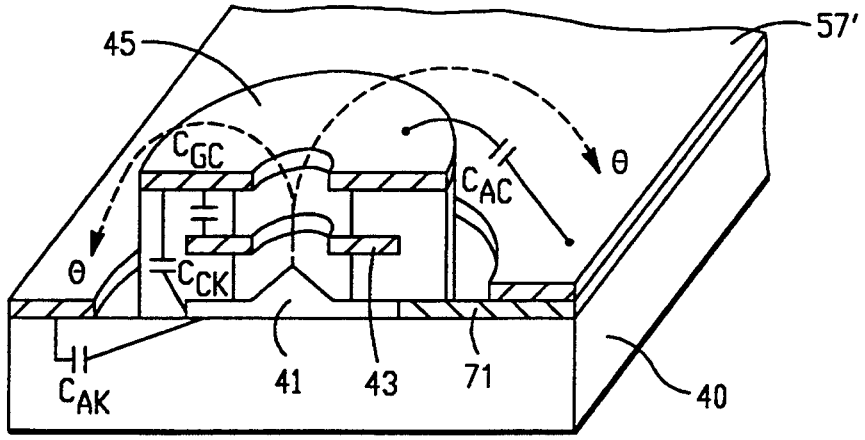
FIG. 36 is a perspective cross sectional view of a second vertically formed emission device.

An example of the second alternative anode structure is illustrated in FIG. 36. In FIG. 36, anode 57' is deposited on a substrate 40' surrounding cathode 41 and insulating material 42. In addition, in order to reduce the capacitance between electrodes and improve the frequency characteristics and breakdown voltage, it is appropriate to make the interconnections 71 at the base of cathode 41 using thin film in order to remove excess and overlapping regions. In this type of situation, an insulated flat substrate 40 would be employed. In addition, it can be readily understood that the capacitances in this second structure are smaller than those of FIG. 35 which impacts the relative frequency characteristics of the two devices.

As with the tetrode field electron emission device of FIG. 24, the multiple electrode field electron emission device is either formed so that gate electrode 43 is perpendicular to the direction of electron emissions from cathode 41 or formed so that the opening of gate electrode 43 surrounds the route of flow of the electrons, reducing the parasite current that flows to gate electrode 43 and yielding excellent power efficiency. The reason for this is that when the emitted electrons pass by gate electrode 43, they only slightly traverse across a distance with the degree of thickness of gate electrode 43. This is, in part, because the emitted electrons have only a small probability of impacting with gate electrode 43 as they pass through the center of the electrode opening. It would be very effective to apply this type of structure to a horizontally structured, multiple electrode field electron emission device.

In order to increase the mutual conductance of a horizontal multiple electrode tube, for example, it is necessary to devise a gate electrode structure in the tetrode field electron emission device shown in FIG. 1 so that the emission surface area of cathode 3 is larger. However, if the emission surface area is increased, there will be an increase in the number of electrons that flow to gate electrode 5. As a result, the problem is that it is difficult to achieve power amplification having high performance.

Figure 25:
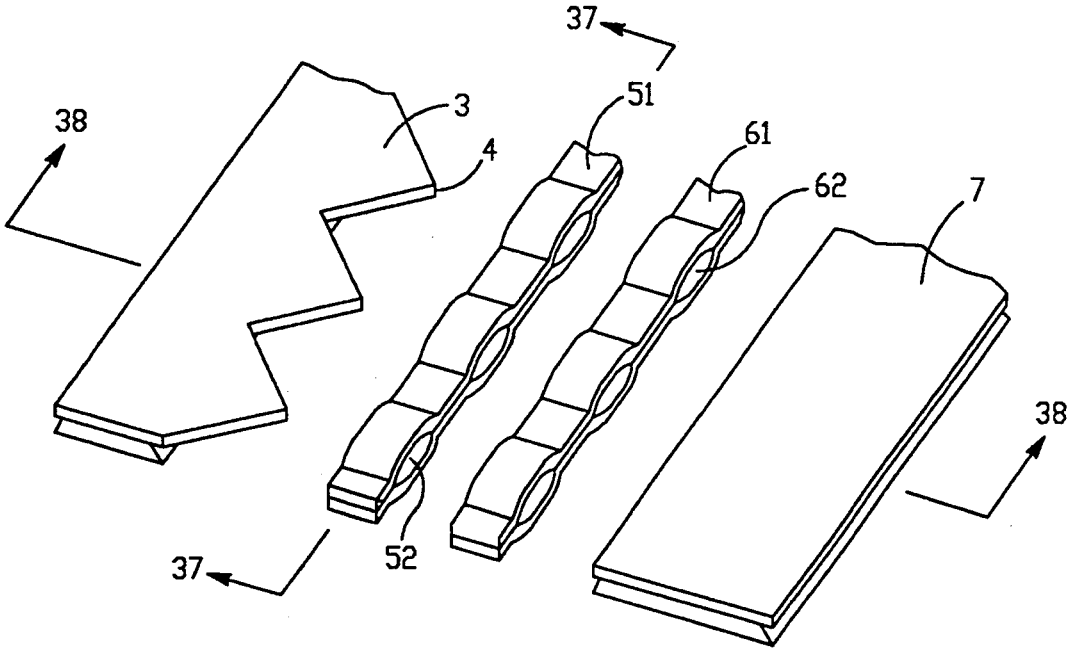
FIG. 25 is a perspective view of a tetrode field electron emission device illustrating openings utilized for the gate electrode and the control electrode.

FIG. 25 is a perspective view of an enlarged multiple electrode electron emission device that has a horizontally arranged, ringed shaped gate electrode 51. The electrode 51 is formed between cathode 3 and anode 7. Cathode 3 has the same basic structure as described and shown in the embodiment of FIG. 1. Openings 52 are formed in a portion of gate electrode 51 and are substantially aligned with the tips of emission projections 4 of cathode 3. This structure reduces the gate and control currents by passing electrons that are emitted from emission projections 4 through openings 52 thereby allowing a reduction in parasite current and an increase in input resistance.

Electrode openings 52 need not be limited to the particular shape shown in FIG. 25. The structure need only be such that ejected electrons are substantially enabled to pass from projections 4 through the electrode apertures. Therefore, openings 52 may be of a circular, square, polygon or other such shape. Even if openings 52 are not formed so as to be substantially in aligned correspondence with emission projections 4 such as in the case, for example, wherein every second opening is formed so as to align with emission projections 4, the electron emission device will still be operational.

Figure 37A:
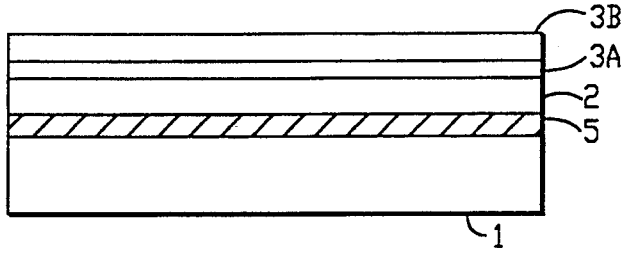
FIG. 37A–37E is a series of cross sectional views taken along line 37—37 of FIG. 25, illustrating a method of forming electron passages for electrodes.
Figure 37B:
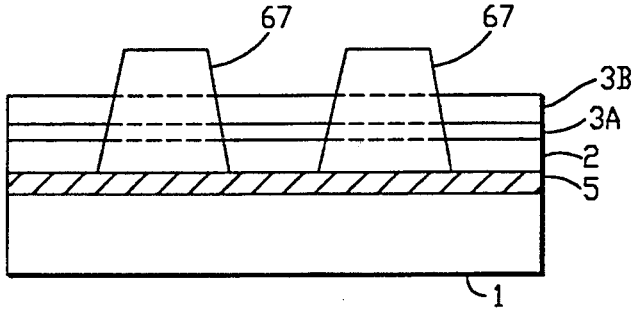
Figure 37C:
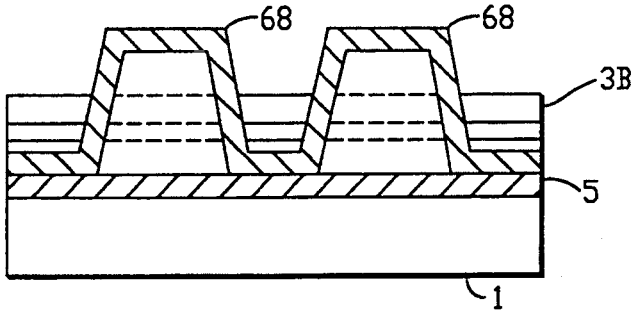
Figure 37D:
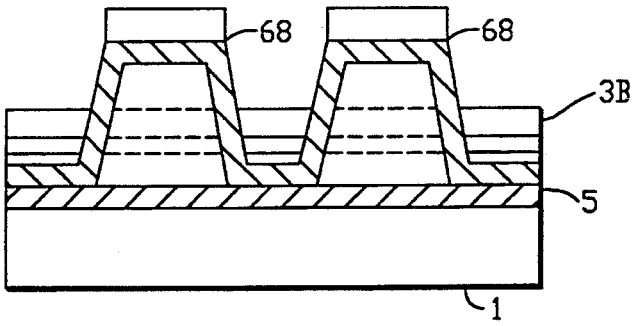
Figure 37E:
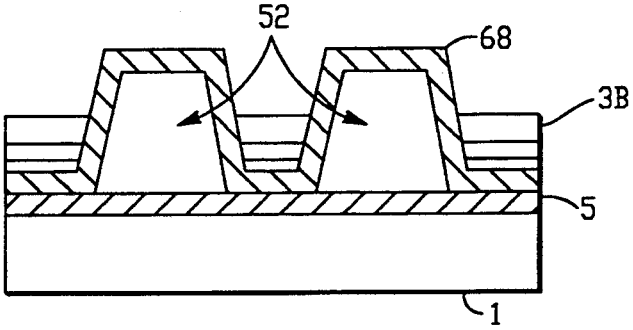
Figure 38A:
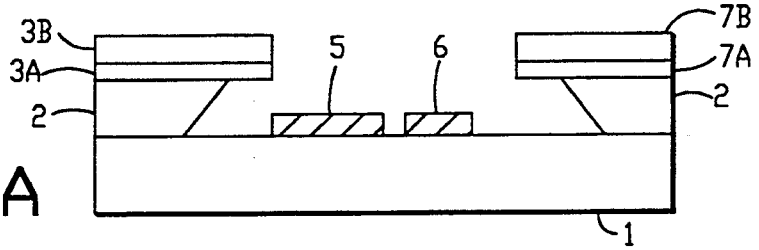
FIG. 38A–38E is a series of cross sectional views taken along line 38—38 of FIG. 25, illustrating a method of forming electron passages for electrodes.

One method of manufacturing the emission device structure of FIG. 25 is illustrated in the steps of FIGS. 37A through 37E and 38A through 38E. FIGS. 37A through 37E are views during processing taken along line 37—37 of FIG. 25, while FIGS. 38A through 38E are views during processing taken along line 38—38 of FIG. 25. In either case, the processing can be viewed as commencing with the emission device structure discussed previously in relation to FIG. 1, as seen in FIGS. 37A and 38A.

Figure 38B:
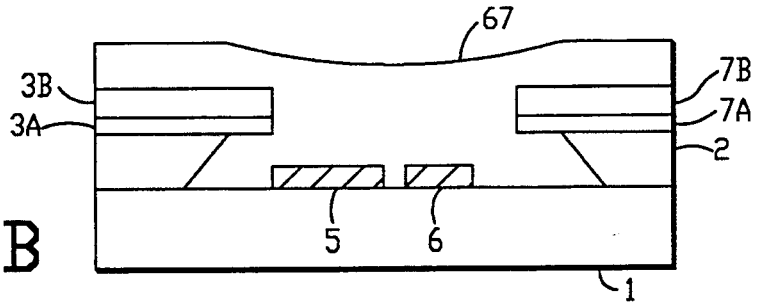

As shown in FIGS. 37B and 38B, a layer of resist or photoresist material 67 is deposited across the emission device, such as by spin coating or the like. The photoresist 67 fills the void between the electrodes 3, 5, 6, and 7, and, as shown in FIG. 38B, is patterned to be present only where appropriate emission elements are located. In other words, the resist 67 is formed only in alignment with the emission electrode tips with which the desired holes or apertures 52, and 62 from below, are to be aligned. At the same time, as shown in FIGS. 37B and 38B the upper surface of photoresist 67 is not necessarily flat. That is, it is often useful to provide a fluted or curved shape to openings 52 (and 62) to assist in directing the trajectory of the electrons. In this case, the surface of resist 67 can be curved to facilitate formation of curvature for openings 52 during processing. However, where desired, the surface of resist 67 could be made substantially flat.

Figure 38C:
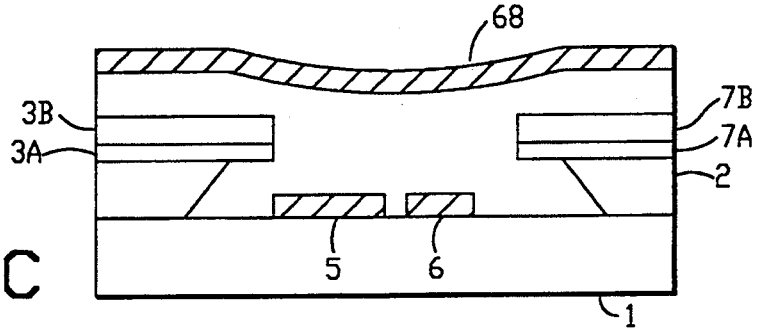
Figure 38D:
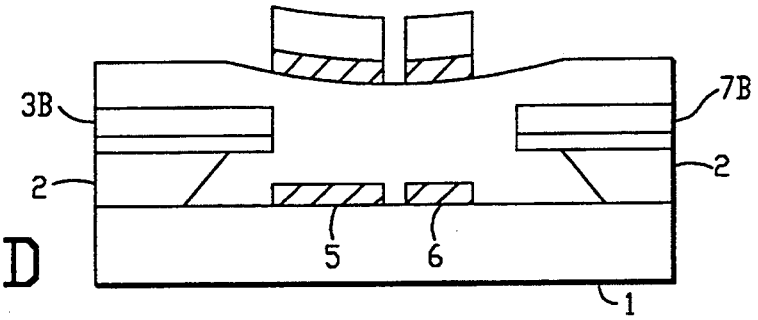
Figure 38E:
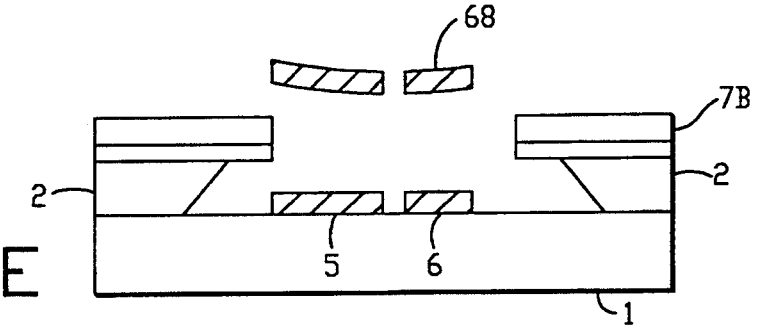

A layer of conductive material 68 used to form a second electrode layer for gate electrode 51, as well as electrode 61 discussed below, is deposited or otherwise formed on the surface of resist 67, as seen in FIGS. 37C and 38C. Another layer of photoresist or resist 69 is subsequently formed on material layer 68 and patterned and etched to cover only a portion of material 68 over electrode 5 of the emission device. At this point, resist 69 is patterned, developed, and removed from material 68 except where it covers electrode 5, see FIGS. 37D and 38D. As shown in FIGS. 37E and 38E, second gate electrode layer 67 is then etched to remove all of the material but that which covers electrode 5.

Where an electrode 62 having a series of holes or apertures 62, is used in place of electrode 6, as discussed blow, material 68 is also positioned over electrode 6 and etched, as shown in FIGS. 37E and 38E, accordingly. In this latter configuration, material 68 can be separated into electrodes 51 and 61 by patterning a space or gap in resist 69 so that etching of material 68 occurs over the area where electrodes 5 and 6 are separated. By etching this area, as shown in FIGS. 37D, 37E, 38D, and 38E, the material 68 is subdivided into two sections each forming one of electrodes 51 or 61.

As previously indicated in connection with FIG. 8, the poor power conversion ratio of $I_G > I_A$ can be improved on by providing an opening in gate electrode 51 so that a field electron emission device with linear input and output electrostatic properties can be offered through the employment of an adjacently formed control electrode 61. In FIG. 25, as with gate electrode 51, the structure of control electrode 61 is also formed to have aligned openings 62 to permit the emission or anode current to pass through them. Alternatively, control electrode 61 may have a flat electrode structure like that shown in the embodiment of FIG. 1.

In the case of a tetrode field electron emission device with the type of gate electrode structure shown in FIG. 25, it is possible for it to have the linear input and output relationship possessed by the structure shown in FIG. 1 as well as possible to drastically reduce the gate current (a gate current of 1/10 or less of the anode current) and drastically reduce the gate parasite current.

Figure 26:
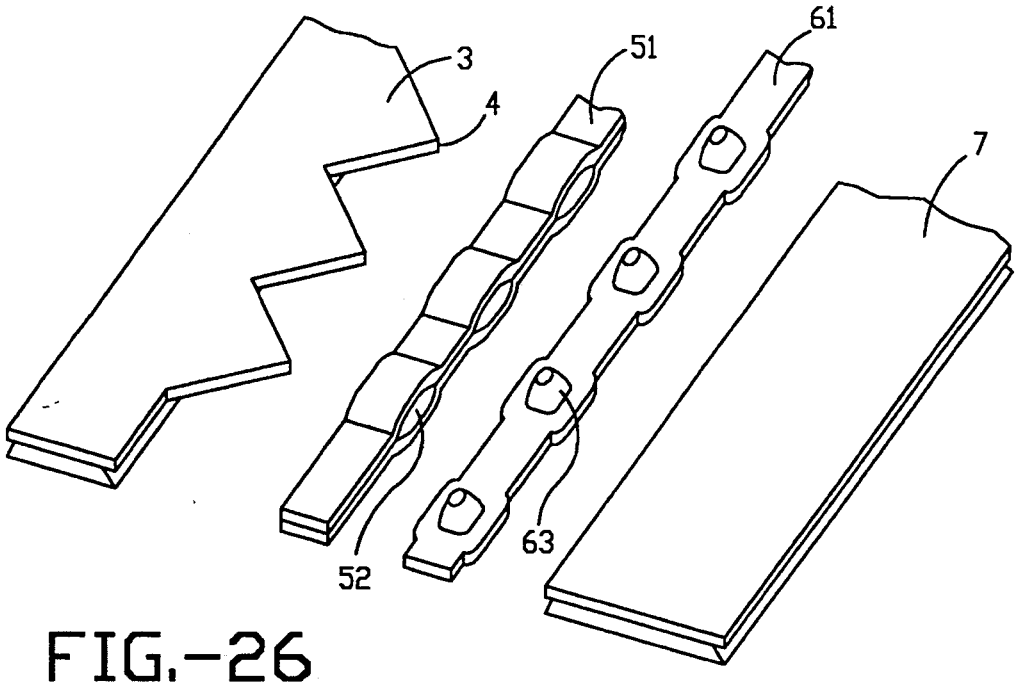
FIG. 26 is a perspective view similar to FIG. 25 except that the control electrodes have a column shaped electrode structure.

An alternate form for control electrode 61 is shown in FIG. 26. Electrode 61 comprises a plurality of columnar shaped control electrodes 63 formed in an aligned arrangement relative to the interval spacing between adjacent openings 52. Control electrodes 63 may be a variety of shapes such as cylindrical, square, conical or pyramid shape in cross section.

The number of electrodes to be formed relative to any embodiment of this invention is optional. Quite naturally, it could be a hexode field electron emission device, for example. It is possible to have the structure of gate electrode 20 of the hexode field electron emission device shown in FIGS. 18A, 18B, and 18C replaced by the gate electrode 51 structure shown in FIG. 25. This would produce a device with gate electrode 5 in FIG. 18 being replaced by the gate electrode 51 structure shown in FIG. 25. In such a case, the electrons that are emitted from emission projections 4 would be controlled by the electric field of control electrode 6, and the amount of electrons reaching anode 7 would be controlled by the control electrode bias. Further, screen electrode 50 will be maintained at a constant electrical bias, preventing fluctuation in the electric field of control electrode 6, which is caused by the electric field of anode 7. Suppressor 53 prevents the secondary electrons generated by anode 7 from returning in the direction toward control electrode 6.

It will be realized by those skilled in the art that the three dimensional gate electrode structure of FIGS. 25 and 26 have problems in terms of manufacturing. For example, the gap control is difficult to master in thin film manufacturing technology. Further, the distribution of the electric field between the cathode and the gate electrode is not uniform so that there is a limit to the $I_a/I_g$ characteristics. Moreover, the manufacturing process requires four photo mask steps, necessitating the use of a complex manufacturing technology. For these reasons, and based on the objective of providing a three dimensional electrical field distribution between the cathode and the gate electrode, it is desirable to provide for the manufacture of a gate electrode of uniform construction and also allow for accurate self alignment.

The foregoing objective can be achieved as follows with a device that forms an extremely stable electrode and greatly improves the Ia/Ig characteristics. This multiple electrode field electron emission device comprises cathodes that are formed on top of the insulating layer that is formed on the surface of the insulated flat substrate, and that has multiple emission projections that overhang frown the insulating layer, including anodes that are formed on the surface of the flat substrate and which collect the emitted electrons, and comprises a number of columnar shaped gate electrodes that are formed in between the cathodes and the anodes. The emission projections are located between the adjacent gate electrodes and the shape of the gate electrodes correspond to emission projections on the cathode. The multiple electrode field electron emission device is fabricated by forming an insulating layer and an electrode layer in sequence on the surface of an insulated flat substrate by leaving a flat pattern of the gate electrodes and applying photoresist. Then, the emission projections are formed by etching beyond the flat pattern using an etching solution that flows from the flat pattern. Lastly, the column shaped gate electrodes are formed in location on the flat pattern and the resist is removed.

Figure 27A:
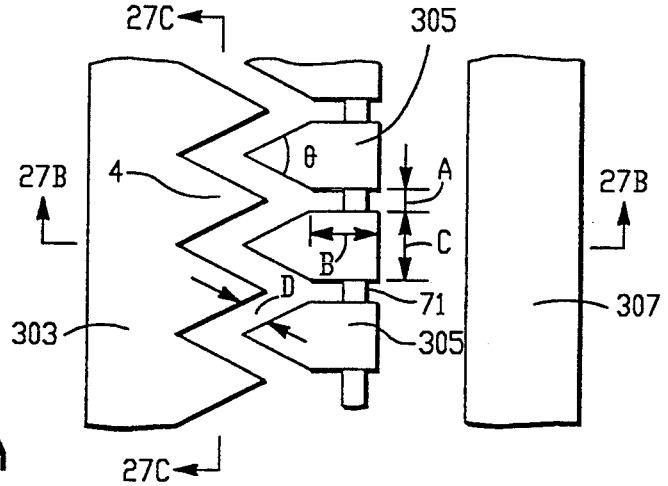
FIG. 27A is a plan view of a triode field electron emission device comprising another embodiment of this invention.
Figure 27B:
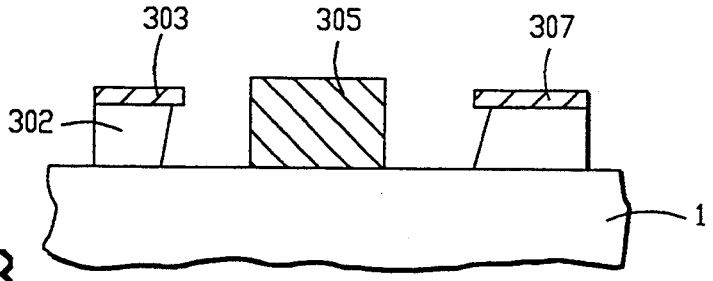
FIG. 27B is a cross section of the device of FIG. 27A taken along the line 27B—27B of FIG. 27A.
Figure 27C:
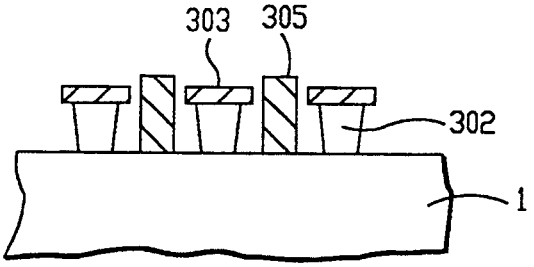
FIG. 27C is a cross section of the device of FIG. 27A taken along the line 27C—27C of FIG. 27A.
Figure 27D:
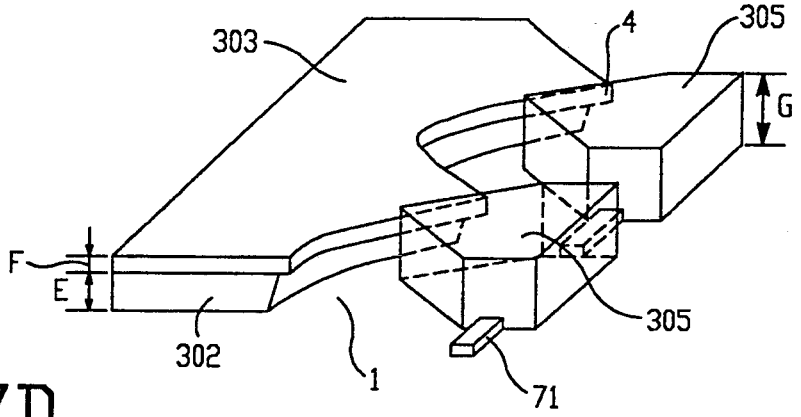
FIG. 27D is a perspective view of the triode field electron emission device of FIG. 27A.

FIG. 27A is a plan view of another embodiment of a multiple electrode field electron emission device of this invention. FIG. 27B is a cross sectional view taken along line 27B—27B of FIG. 27A. FIG. 27C is a cross sectional view taken along line 27C—27C of FIG. 27A. FIG. 27D is a perspective view of an enlarged portion of the device shown in FIG. 27A. In FIG. 27A, cathode 303, gate electrode 305, and anode 307 are formed on the flat surface of substrate 1 which comprises quartz. Cathode 303 is formed as a thin film, for example, having a thickness of 2,000 angstroms, on the surface of silicon dioxide island shaped insulating layer 302. Overhanging emission projections 4 are formed in cathode 303. Cathode 303 may be fabricated from two or more thin film layers. For example, cathode 303 may be a molybdenum thin film formed on top of a tungsten thin film. Emission projections 4 have tips that project in the direction of gate electrodes 305 with surfaces substantially parallel with the surface of flat substrate 1. Island shaped insulating layer 302 does not exist below the tip area of emission projections 4. The tip curvature radius of emission projections 4, as viewed from their planar extent, is 400 angstroms or less.

The structure of gate electrodes 305 is formed so as to self align with the structure of cathode 303. Relative to the pentagonal column shape of electrodes 305, one corner facing in the direction of cathode 303 has, for example, an angle $\theta$ in the range from 60 degrees to 90 degrees. Emission projections 4 are formed in the interval between adjacent gate electrodes 305. Therefore, the electrical field distribution in the vicinity of emission projections 4 is laterally symmetrical. If the height, G, of the pentagonal column of gate electrodes 305 is formed so as to be taller than that of cathode 303, the distribution of the electrical field in the area of emission projections 4 will be laterally symmetrical as well as substantially uniform in the vertical direction. As a result, the electrons emitted from emission projections 4 by means of an established electrical field between cathode 303 and gate electrodes 305 will pass through the spatial interval between gate electrodes 305 and arrive in an efficient manner at anode 307. This will allow a marked reduction in the parasitic current in the gate current, i.e., the $I_a/I_g$ characteristics (power conversion ratio) will be a significantly improved.

The structure of gate electrode 305 is not limited to a pentagonal column shape. The structure can be a column shape wherein a symmetrical electric field is formed in the vicinity of the emission projections 4 and in which the emitted electrons are efficiently emitted to anode 307. Other examples are a triangular column shape or a column shape with a curved back.

In the foregoing embodiment, a flat triode field electron emission device has been disclosed. However, this embodiment can also be easily modified to have a tetrode or pentode type electrode field electron emission structure.

In FIGS. 27A–27D, gate electrodes 305 are connected by means of gate electrode interconnect 71. As an example of the dimensions for this embodiment, the distance A, between gate electrodes 305, may be about 3 μm. Distance B of the pentagonal column of gate electrodes 305 may be about 5 μm. Distance C may be about 7 μm. Gap D between gate electrode 305 and cathode 3 may be about 1.5 μm. The thickness of the island shaped insulating layer 302 may be about 0.5 μm. The thickness F of electrode 303 may be about 0.1 μm.

Figure 28A:
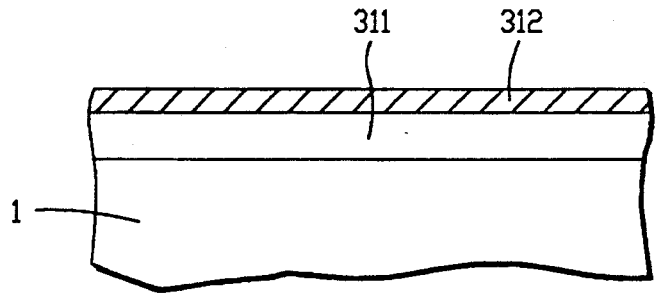
FIGS. 28A–28C are a series of first figures illustrating the steps of manufacture of the tetrode field electron emission device of FIG. 27A.
Figure 28B:
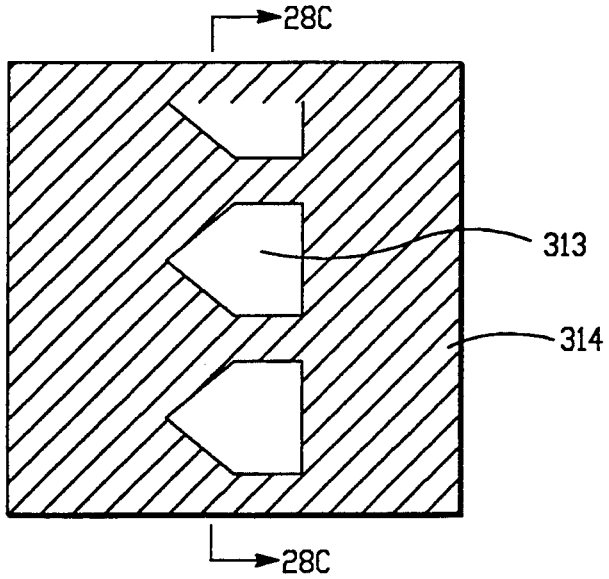
Figure 28C:
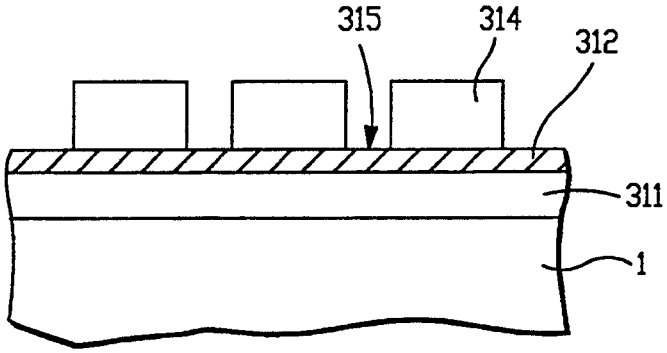

Next to be described is the manufacturing process for the embodiment of FIGS. 26A–27D. FIGS. 28, 29, and 30 each describe manufacturing steps followed for this embodiment. First, as indicated in FIG. 28A, a thermal CVD method is used to form silicon dioxide thin film 311 on the surface of substrate base 1, which is made of quartz glass, etc. Next, a technique, such as, sputtering is employed to form tungsten layer 312 on top of silicon dioxide thin film layer 311. However, the material for this layer is not limited to tungsten. For example, it could be a material, such as, tantalum. After this, as indicated in FIG. 28B, resist holes 313, remain which have the shape of the cross section of gate electrode columns, and a resist layer 314 is formed. FIG. 28C is a cross sectional view taken along the line 28C—28C of FIG. 28B. Layer 314 is selectively etched with $CF_4$ gas, etc., tungsten layer 314, which is exposed in resist holes 313 is etched. As a result, as shown in FIG. 29A, silicon dioxide layer 316 in FIG. 28C is exposed.

Figure 29A:
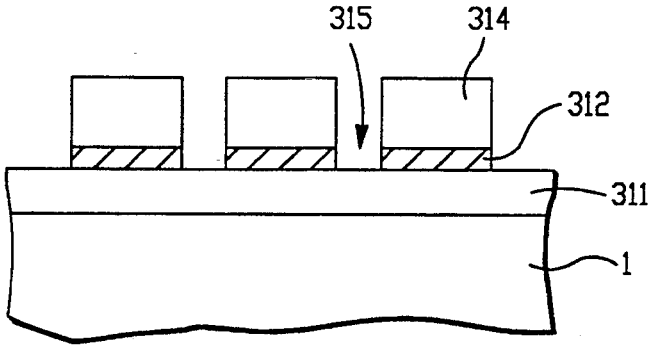
FIGS. 29A–29D are a series of second figures illustrating the steps of manufacture of the tetrode field electron emission device of FIG. 27A where
Figure 29B:
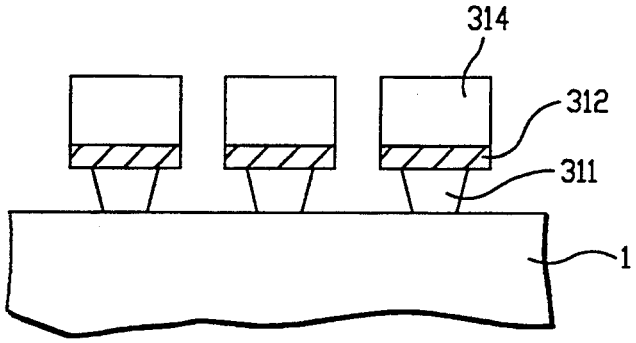

After this, using an HF type etching solution, silicon dioxide film 316 in FIG. 29A is etched. When that film is over-etched, the reverse taper shown by the cross section of silicon dioxide film 311 in FIG. 29B is obtained. Next, when tungsten film 312 is etched with a $CH_4$ type etching solution, the etching of the tungsten progresses to dotted lines 317 and 318 shown in FIG. 29C. This results in the formation of cathode emission projections 319. Since the etch solution that flows from resist holes 313 over-etches the tungsten film along the shape of resist holes 313 from both sides of resist holes 313, the tips of emission projections 319, which is part of the cathode that is formed, are sharp. In addition, and the tip position is equally distant from the adjacent resist holes 313. As a result, in the manufacturing process, it possible for the emission projection 319 that is formed to always be positioned in the middle of the adjacent resist hole 313, even though there may be an error in the positioning of resist hole 313. Also, the distribution of the electrical field formed by emission projection 319 and the gate electrode is always laterally symmetrical. That is, it is possible to form the cathode and the gate electrode so that they self align.

Figure 30A:
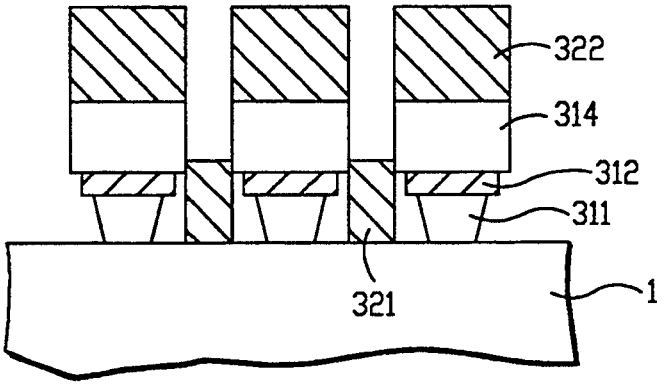
FIGS. 30A and 30B are a series of third figures illustrating the steps of manufacture of the tetrode field electron emission device of FIG. 27A.
Figure 30B:
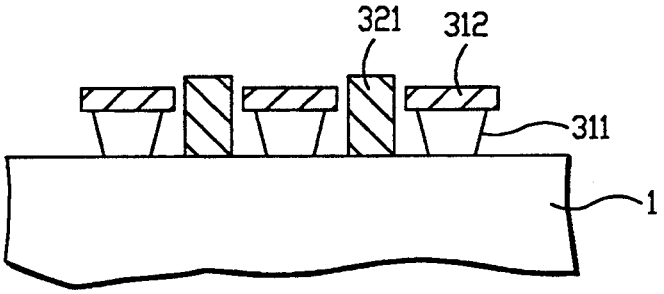

After this, a film of molybdenum, etc., the material that forms the gate electrode, is formed using vapor deposition or sputtering to yield molybdenum films 321 and 322. These are shown in the cross section in FIG. 30A. As for molybdenum film 321, the flat shape is the same as that of the gate electrode, which has the same shape as resist hole 313. Depending on the manufacturing conditions of the vapor deposition or the sputtering, it is possible to form molybdenum film 321 at a height that is higher than tungsten film 312. When resist layer 314 is lifted off, the results are as shown in FIG. 30A and FIG. 30B. The cathode and gate electrodes will be formed as shown in FIG. 27C.

Figure 29C:
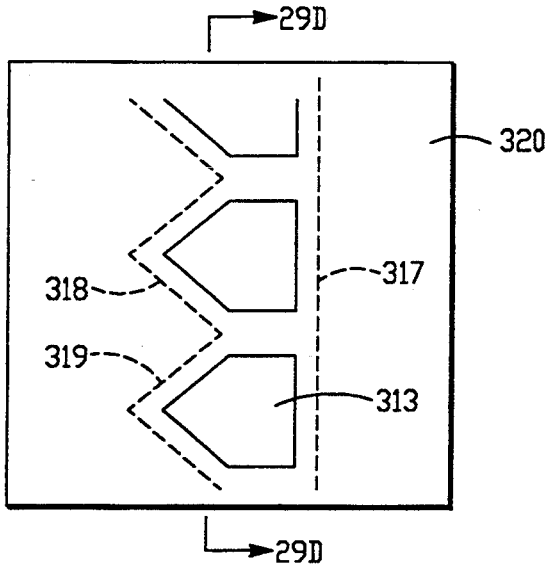
Figure 29D:
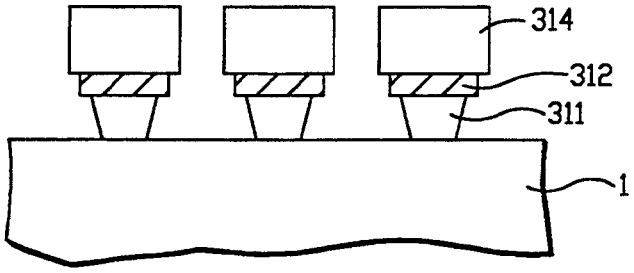

As for the formation of the anode in this invention, when the area of broken line 317 is etched, and this area is formed through over-etching in the step shown in FIG. 29C, tungsten film 320 may be used as the anode. In addition, the anode may be fabricated separately. However, in such a case, tungsten film 320 may also be used as the control electrode of a multiple electrode field electron emission device, or it may be eliminated if it is not necessary.

The gate electrode interconnect 71 is fabricated in advance using a photo mask. Therefore, with this manufacturing process, it is possible to fabricate using two photo mask steps, a photo mask step that patterns the gate electrode interconnects and a photo mask step that forms the resist film shown in FIG. 28B.

The location of the gate electrode interconnect can be placed where desired. Therefore, if it is formed close to the cathode, the electric field between the cathode and the electrode will increase, offering a device with an excellent electric field.

Figure 31:
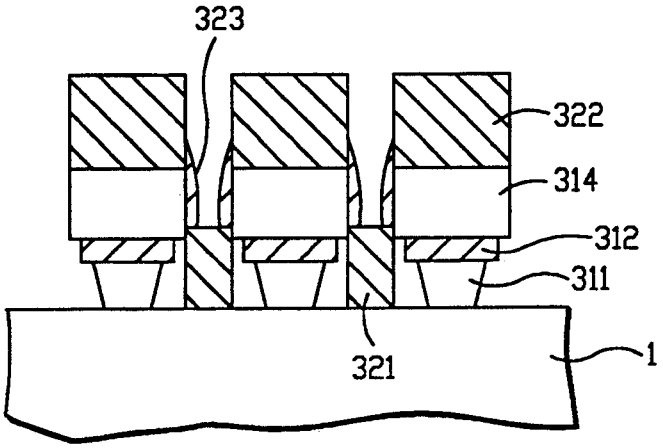
FIG. 31 is a cross sectional illustration of the formation of a bridge structure in the manufacturing process illustrated in FIGS. 29A–29D and FIGS. 30A–30B.

In the step of FIG. 30A in the manufacturing process described above, when the molybdenum layer is formed either by vapor deposition or sputtering, sometimes a molybdenum bridge is formed between molybdenum film 321 and molybdenum film 322, as shown in FIG. 31. Since this is not good for the formation of the gate electrode, the manufacturing process should be one that does not form bridge 323.

Figure 32A:
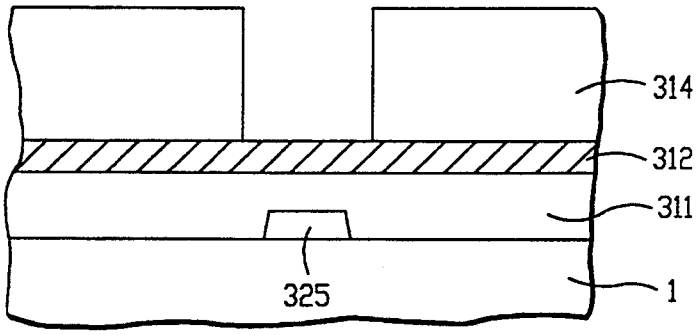
FIGS. 32A–32G is a series of cross sectional illustrations of how not to form a bridge structure in the manufacturing process illustrated in FIGS. 29A–29D and FIGS. 30A–30B.

Such a manufacturing process is shown as an example below. FIG. 32A is an enlargement of a section of FIG. 28C, showing the same manufacturing steps. When the gate electrodes are formed in advance on substrate base 1, interconnect pattern 325, which corresponds to the shape of the resist holes, can be fabricated. The material for interconnect pattern 325 may be, for example, aluminum, but may also be other types of material.

Figure 32B:
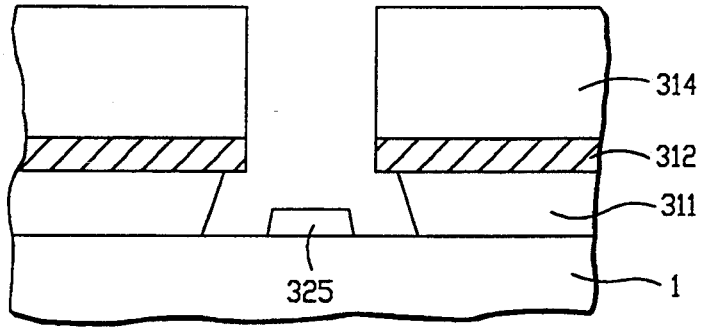
Figure 32C:
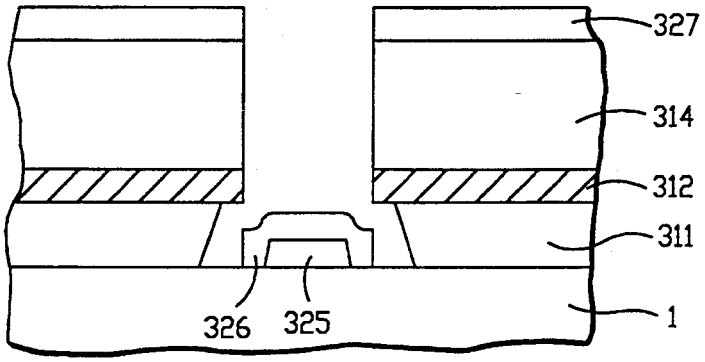

In this configuration, when silicon dioxide layer 311 is over-etched, as shown in FIG. 32B, the interconnect pattern is exposed. Therefore, as shown in FIG. 32C, a thin layer of aluminum 326 is formed on top of the interconnect pattern 325 by means of vapor deposition or sputtering. Aluminum layer 327 is formed on top of resist layer 314.

Figure 32D:
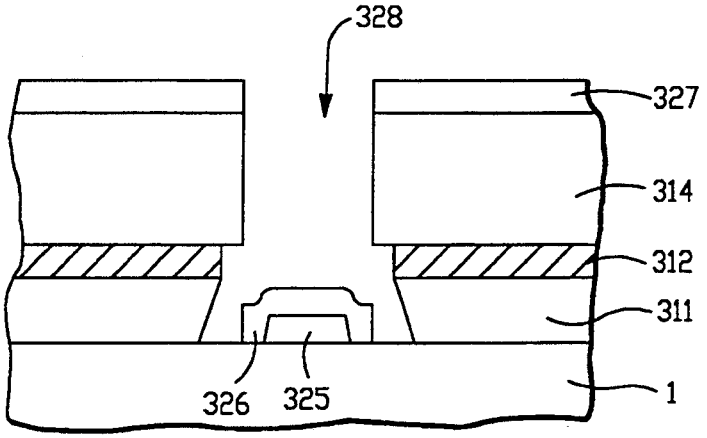
Figure 32E:
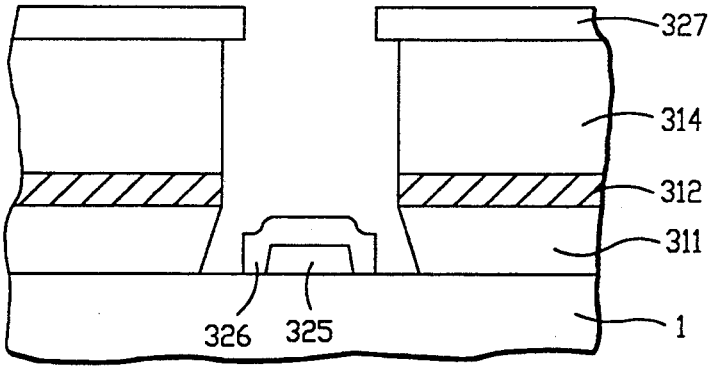
Figure 32F:
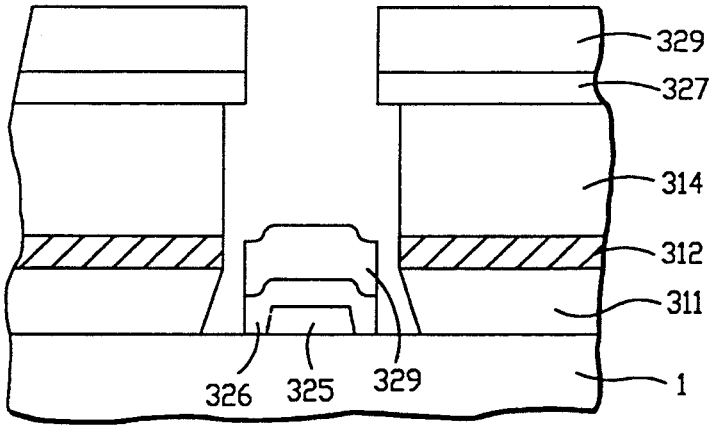
Figure 32G:
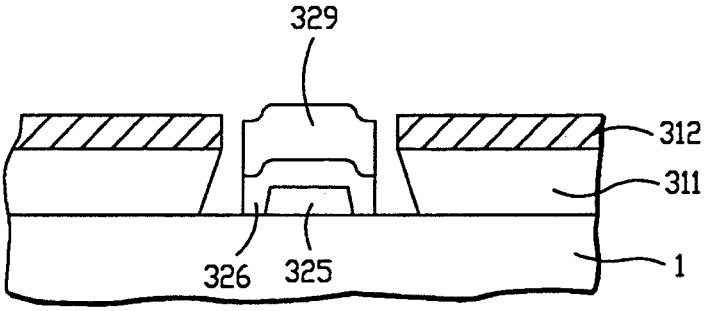
Figure 33:
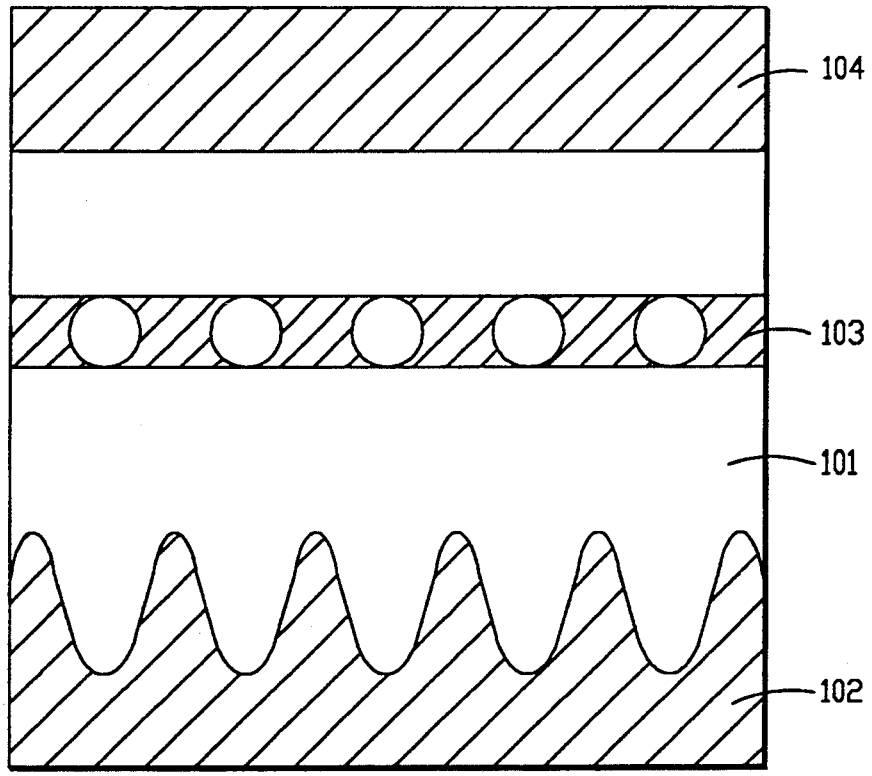
FIG.-33 PRIOR ART
FIG. 33 is a cross sectional illustration of a triode field electron emission device known in the art.

Next, after tungsten layer 312 is over-etched, as shown in FIG. 32D, resist layer 314, which is around the periphery of resist hole 328, is removed using oxygen plasma forming the structure as shown in FIG. 32E. Next, gate electrode metal 329, which is the material for the gate electrode (which may be aluminum or molybdenum) is formed by means of vapor deposition or sputtering as illustrated in FIG. 32F. After that, the resist may be removed as illustrated in FIG. 32G. When forming the gate electrode by means of this manufacturing process, the bridge described above is difficult to form because the periphery of resist layer 14 is removed.

The invention as disclosed in the several embodiments of this invention has the following advantages.

(1) Because the voltage of the control electrode and the current of the anode are in a linear relationship, the input and output transference characteristics are linear. Further, the anode resistance is very large. As a result, it can be used in a linear amplifier, something that has been difficult with the technology of the prior art.

(2) The parasite current that flows to the gate has been decreased markedly. From the perspective of the consumption of current, it is a multiple electrode field electron emission device which has an effective linear amplification effect.

(3) Because the input resistance of the control electrode is very large, it can be used in field effect amplifiers and switching devices.

(4) Compared to the thermo-electronic emission vacuum tubes of the prior art, the current, voltage, and power that can be handled is either the same or better. In addition, it is very small.

(5) Because mutual conductance and the degree of linearity of the transference characteristics can be controlled by the gate voltage, even using the same device, special parameters can easily form different circuits.

(6) There is a great degree of freedom in configuring a device that responds to an application, such as a device with excellent frequency characteristics, a device with excellent power efficiency, or a device that is able to handle large and small power supplies.

While the invention has been described in conjunction with several specific embodiments, it is evident to those skilled in the art that many further alternatives, modifications and variations will be apparent in light of the forgoing description. Thus, the invention described herein is intended to embrace all such alternatives, modifications, applications and variations as may fall within the spirit and scope of the appended claims.

What is claimed is:

1. A multiple electrode field electron emission device comprising:

a cathode that ejects electrons by means of an established field effect and comprising two layers of mutually different materials;

a gate electrode disposed adjacent to said cathode for applying an electric field on said cathode;

an anode disposed adjacent to said gate electrode for collecting ejected electrons, wherein said gate electrode is arranged between said anode and said cathode; and a control electrode formed between said gate electrode and said anode for controlling the amount of said ejected electrons reaching said anode.

2. The multiple electrode field electron emission device of claim 1 further comprising a screen electrode disposed between said control electrode and said anode to electrostatically screen said control electrode from said anode.

3. The multiple electrode filed electron emission device of claim 2, further comprising a suppressor electrode disposed between said screen electrode and said anode for controlling secondary electrodes emitted from said anode.

4. A multiple electrode field electron emission device comprising:

an insulated fiat substrate;

an island shaped insulating layer disposed on one surface of said substrate;

a cathode comprising two layers of mutually different materials and having a plurality of emission projections disposed on a surface of said insulting layer and having a portion overhanging an edge thereof;

a gate electrode disposed on said surface of said fiat substrate in proximity to said emission projections;

an anode disposed on said surface of said fiat substrate in opposite relation to said cathode emission projections, wherein said gate electrode is located between said anode and said cathode; and a control electrode disposed between said gate electrode and said anode on said surface of said fiat substrate.

5. The multiple electrode field electron emission device of claim 4 wherein a portion of said control electrode has a substantially columnar shape.

6. The multiple electrode field electron emission device of claim 4, further comprising a screen electrode disposed between said control electrode and said anode on said surface of said fiat substrate.

7. The multiple electrode field electron emission device of claim 6 wherein portions of both said control and screen electrodes have substantially columnar shapes.

8. The multiple electrode field electron emission device of claim 6 further comprising a suppressor electrode formed between said screen electrode and said anode on said surface of said flat substrate.

9. The multiple electrode field electron emission device of claim 4 wherein said gate has at least one opening substantially aligned with an emission projection for passage of electrons emitted from said emission projection.

10. A multiple electrode field electron emission device comprising:

a conductive flat substrate:

a first insulating layer disposed on said flat substrate;

a substantially pointed shaped cathode comprising two layers of mutually different materials having a first portion and a peripheral portion, said first portion being disposed on said first insulating layer so that said peripheral portion of cathode is projected over a surface of said substrate;

a gate electrode layer disposed on said substrate such that said peripheral portion of said cathode faces a portion of said gate electrode layer;

an opposing substrate arranged on a surface of said opposing substrate facing said conductive substrate; and a control electrode disposed in between said gate electrode layer and said anode layer.

11. A method of driving a multiple electrode field electron emission device having a cathode for ejecting electrons by means of an established field effect, a gate electrode disposed adjacent to the cathode for applying an electric field on the cathode, an anode disposed adjacent to the gate for collecting the ejected electrons, and a control electrode disposed between the cathode and the anode for controlling the amount of ejected electrons reaching the anode, said driving method comprising the steps of:

ground the cathode;

applying a positive bias gate voltage to the gate electrode;

applying a positive bias voltage to the anode larger than the voltage on the gate; and applying an input signal voltage to the control electrode to control the amount of anode current flow.

12. A method of driving a multiple electrode field electron emission device having a cathode for ejecting electrons by means of an established field effect, a gate electrode disposed adjacent to the cathode for applying an electric field to the cathode, an anode disposed adjacent to the gate electrode for collecting the ejected electrons, and a control electrode disposed between the cathode and the anode for controlling the amount of ejected electrons reaching the anode, said driving method comprising the steps of:

grounding the gate electrode:

applying a negative bias voltage to the cathode;

applying positive bias voltage to the anode; and applying an input signal voltage to the control electrode to control the amount of anode current flow.

13. The method of claim 12 wherein said negative bias cathode voltage is applied to said cathode through a resistance in series with the cathode.

14. The method of claim 12 further comprising the steps of:

providing a screen electrode positioned between the control electrode and the anode to electrostatically screen the control electrode from the anode; and applying positive bias screen voltage on the screen electrode.

15. A method of driving a multiple electrode field electron emission device having a cathode for ejecting electrons by means of an established field effect, a gate electrode disposed adjacent to the cathode for applying an electric field to the cathode, an anode disposed adjacent to the gate electrode for collecting the ejected electrons, and a control electrode disposed between the cathode and the anode for controlling the amount of ejected electrons reaching the anode, a screen electrode disposed between the control electrode and the anode to electrostatically screen the control electrode and the anode to electrostatically screen the control electrode from the anode, and a suppressor electrode disposed between said screen electrode and said anode, the driving method comprising the steps of:

grounding the cathode and the suppressor electrode;

applying a gate voltage on the gate electrode and the screen electrode;

applying an anode voltage to the anode; and applying an input signal voltage to the control electrode to control the amount of anode current flow.

16. A multiple electrode field electron emission device comprising a cathode arranged on an insulating layer arranged on a surface of a fiat substrate, said cathode comprising two layers of mutually different materials having a plurality of emission projections having ends overhanging a portion of said insulating layers, an anode arranged on said flat substrate surface for collecting ejected electrons, a gate electrode arranged between said cathode and said anode and having at least one opening substantially aligned with an emission projection for passage of electrons emitted from said emission projection, and a control electrode arranged between said gate electrode and said anode.

17. The multiple electrode field electron emission device of claim 16, said at least one opening is arranged along said gate electrode corresponding in aligned relation to said at least one emission projection.

18. The multiple electrode field electron emission device of claim 16 further comprising a screen electrode formed between said control electrode and said anode.

19. The multiple electrode field electron emission device of claim 18, said at least one opening is arranged along said gate electrode corresponding in aligned relation to said at least one emission projection.

20. The multiple electrode field electron emission device of claim 17 further comprising a suppressor electrode formed between said screen electrode and said anode.

21. The multiple electrode field electron emission device of claim 20, said at least one opening is arranged along said gate electrode corresponding in aligned relation to said at least one emission projection.

22. The multiple electrode field electron emission device of claim 16 wherein passages are formed in said control electrode corresponding in aligned relation with said openings in said gate electrode.

23. A method of manufacturing a field electron emission device having a cathode comprising two layers of mutually different materials arranged on a surface of a fiat substrate, a gate electrode arranged adjacent to the cathode for applying an electric field to the cathode, an anode arranged adjacent to the gate electrode for collecting the ejected electrons, and a control electrode arranged between the cathode and the electrons, and a control electrode arranged between the cathode and the anode for controlling the amount of ejected electrons reaching the anode, said method comprising the steps of:

forming an emission projection having a body portion that projects in a plane substantially parallel to said fiat substrate surface and contains at least an etching mask layer on the surface of said fiat substrate, and a cathode layer on the surface of the said etching mask layer;

depositing an etching passivation layer on said cathode layer and fabricating the etching mask layer to form an etching mask, which has the emission projections; and forming said cathode layers on the fiat surface of the etching mask and with emission projections.

24. A method process for a field electron emission device comprising the steps of forming an etching mask layer on the surface of a fiat substrate base, forming a cathode layer comprising two layers of mutually different materials on the surface of the etching mask layer, forming a photoresist layer on the surface of said cathode layer, fabricating said cathode layer in the fiat shape of said photoresist layer, fabricating said etching mask layer using an over-etching method, fabricating said cathode layer in the shape of the etching mask to form the cathode, removing said etching mask from a lower circumference of the cathode to form said cathode in an eave-shape, a process that forms the gate electrode layer using a particulate deposition method, and a process that fabricates said gate electrode layer to form the gate electrode.

* * * * *